US009810496B2

(12) United States Patent
Kolev et al.

(10) Patent No.: US 9,810,496 B2
(45) Date of Patent: Nov. 7, 2017

(54) SEMIAUTOMATIC FIREARM

(71) Applicant: Savage Arms, Inc., Westfield, MA (US)

(72) Inventors: Ivan Kolev, Broad Brook, CT (US); John Linscott, Holyoke, MA (US)

(73) Assignee: Savage Arms, Inc., Westfield, MA (US)

( * ) Notice: Subject to any disclaimer, the term of this patent is extended or adjusted under 35 U.S.C. 154(b) by 0 days.

(21) Appl. No.: 14/599,396

(22) Filed: Jan. 16, 2015

(65) Prior Publication Data

US 2015/0330734 A1 Nov. 19, 2015

Related U.S. Application Data

(60) Provisional application No. 61/993,541, filed on May 15, 2014, provisional application No. 61/993,563,
(Continued)

(51) Int. Cl.
*F41A 19/14* (2006.01)
*F41A 15/14* (2006.01)
(Continued)

(52) U.S. Cl.
CPC ..... *F41A 15/14* (2013.01); *F41A 3/12* (2013.01); *F41A 3/46* (2013.01); *F41A 3/66* (2013.01);
(Continued)

(58) Field of Classification Search
None
See application file for complete search history.

(56) References Cited

U.S. PATENT DOCUMENTS 1,410,270 A 3/1922 Pedersen
1,656,961 A 1/1928 Soncini
(Continued)

FOREIGN PATENT DOCUMENTS

CH 626 717 * 11/1981 ..... F41D 11/10
EP 0 017 506 10/1980
WO WO 94/09334 4/1994

OTHER PUBLICATIONS

Guns & Ammo Network, "Innovative, Remarkable, Reliable . . . Getting Inside Savage's Accutrigger". Sep. 23, 2010. Available online at: http://www.shootingtimes.com/long-guns/longgun_reviews_savage_0813/ (8 pgs.).
(Continued)

*Primary Examiner* — Stephen M Johnson
(74) *Attorney, Agent, or Firm* — Christensen Fonder Dardi Herbert PLLC

(57) ABSTRACT

A semiautomatic firearm with redundant systems for reducing misfirings. A safety trigger is provided that is passively actuated in advance of a firing trigger. The safety trigger maintains redundant safety mechanisms that prevent inadvertent or accidental actuation of the firing trigger. The firing trigger can be configured for actuation with a very low magnitude or "soft" pull without compromising safety. For the disclosed embodiments, the safety trigger assures that the firearm is discharged only upon deliberate actuation of the firing trigger. In one embodiment, a trigger pull adjustment mechanism provides adjustment of the pull of the firing trigger to a desired force required by the operator. The disclosed trigger pull adjustment mechanism reduces the number of components and complexity of the machined parts over conventional trigger pull adjustment mechanisms.

13 Claims, 28 Drawing Sheets

Related U.S. Application Data filed on May 15, 2014, provisional application No. 61/993,569, filed on May 15, 2014.

(51) Int. Cl.

| | |
|---|---|
| ***F41A 19/10*** | (2006.01) |
| ***F41A 19/12*** | (2006.01) |
| ***F41A 19/16*** | (2006.01) |
| ***F41A 3/12*** | (2006.01) |
| ***F41A 3/66*** | (2006.01) |
| ***F41A 19/27*** | (2006.01) |
| ***F41A 21/00*** | (2006.01) |
| ***F41A 3/46*** | (2006.01) |
| *F41A 17/46* | (2006.01) |

(52) U.S. Cl.

CPC ..... *F41A 19/10* (2013.01); *F41A 19/12* (2013.01); *F41A 19/16* (2013.01); *F41A 19/27* (2013.01); *F41A 21/00* (2013.01); *F41A 17/46* (2013.01); *F41A 19/14* (2013.01)

(56) References Cited

U.S. PATENT DOCUMENTS

| | | | | |
|---|---|---|---|---|
| 1,737,974 | A | | 12/1929 | Pedersen |
| 2,453,830 | A | | 11/1948 | Chadwick et al. |
| 2,465,749 | A | | 3/1949 | Rataiczak |
| 2,473,373 | A | | 6/1949 | Howell |
| 2,527,895 | A | | 10/1950 | Tassan |
| 2,576,973 | A | | 12/1951 | Simpson |
| 2,585,195 | A | | 2/1952 | Walker |
| 2,594,354 | A | | 4/1952 | Schnepel |
| 2,601,808 | A | | 7/1952 | Clarke |
| 2,603,019 | A | | 7/1952 | Elkas |
| 2,626,474 | A | | 1/1953 | Lochhead |
| 2,638,694 | A | | 5/1953 | Morris |
| 2,873,546 | A | | 2/1959 | Allyn |
| 2,912,779 | A | | 11/1959 | Catlin et al. |
| 2,921,502 | A | | 1/1960 | Amsler |
| 2,975,680 | A | | 3/1961 | Wilson |
| 3,235,993 | A | | 2/1966 | Magardo |
| 3,292,492 | A | * | 12/1966 | Sturtevant ..... F41A 17/46 89/128 |
| 3,631,622 | A | | 1/1972 | Walker et al. |
| 3,738,223 | A | | 6/1973 | Post et al. |
| 3,848,510 | A | | 11/1974 | Wolpert |
| 3,857,325 | A | | 12/1974 | Thomas |
| 3,893,369 | A | | 7/1975 | Benelli |
| 4,069,607 | A | | 1/1978 | Jurek |
| 4,203,243 | A | | 5/1980 | Hickman |
| 4,270,295 | A | | 6/1981 | Grehl |
| 4,344,246 | A | | 8/1982 | Bauman et al. |
| 4,547,988 | A | | 10/1985 | Nilsson |
| 5,157,209 | A | | 10/1992 | Dunn |
| 5,655,326 | A | | 8/1997 | Levavi et al. |
| 5,666,754 | A | | 9/1997 | de Oliveira Masina |
| 5,760,328 | A | * | 6/1998 | Robbins ..... F41A 19/46 89/129.02 |
| 5,900,576 | A | | 5/1999 | Gabriel |
| 5,974,942 | A | | 11/1999 | Dionne |
| 6,256,918 | B1 | | 7/2001 | Szabo |
| 6,418,655 | B1 | | 7/2002 | Kay |
| 6,553,706 | B1 | | 4/2003 | Gancarz et al. |
| 6,782,791 | B2 | | 8/2004 | Moore |
| 7,204,051 | B2 | | 4/2007 | Thomele et al. |
| 8,122,633 | B2 | | 2/2012 | Kerbrat et al. |
| 8,220,193 | B1 | | 7/2012 | Lynch |
| 8,250,799 | B2 | | 8/2012 | Duperry et al. |
| 8,528,458 | B2 | | 9/2013 | Windauer |
| 2005/0257682 | A1 | | 11/2005 | Hajjar et al. |
| 2010/0024273 | A1 | | 2/2010 | Duperry et al. |
| 2010/0186581 | A1 | | 7/2010 | Hajjar et al. |
| 2010/0313459 | A1 | | 12/2010 | Gomez |
| 2011/0079137 | A1 | * | 4/2011 | Audibert ..... F41A 19/10 89/136 |
| 2013/0074390 | A1 | | 3/2013 | Wössner et al. |
| 2013/0199069 | A1 | | 8/2013 | Kerbrat et al. |
| 2015/0330731 | A1 | | 11/2015 | Kolev et al. |

OTHER PUBLICATIONS

English translation of CH 626717.

* cited by examiner

SEMIAUTOMATIC FIREARM

RELATED APPLICATIONS

This application claims the benefit of U.S. Provisional Patent Application Nos. 61/993,541, filed on May 15, 2014, 61/993,563, filed on May 15, 2014, and 61/993,569, filed on May 15, 2014, the disclosures of which are incorporated by reference herein in their entirety.

BACKGROUND OF THE DISCLOSURE

Semiautomatic firearms for 22 caliber rimfire cartridges are extremely popular as evidenced by the many makes and models available. Semiautomatic rifles for higher power rimfire cartridges, for example .17 HSR and .17 WSM are not presently available. Previous commercial models for these rimfire cartridges proved to be unreliable and prone to malfunctions. Mechanisms, particularly the trigger assemblies, safety mechanisms and cycling mechanisms typically used for conventional .22 caliber ammunition are not believed to be robust and reliable enough for these higher powered rimfire cartridges.

A reliable semiautomatic firearm with suitable mechanisms to mitigate misfires and out of breech firings and other malfunctions would be welcomed.

SUMMARY OF THE DISCLOSURE

Various embodiments of semiautomatic firearms with robust and redundant systems for reducing malfunctions are disclosed, suitable for use with, for example, higher powered rimfire cartridges, such as .17 HSR and .17 WSM. The embodiments disclosed herein may also be utilized in firearms that fire centerfire cartridges and in .22 caliber firearms. A safety trigger is provided that is passively actuated in advance of a firing trigger. The safety trigger maintains redundant safety mechanisms that prevent inadvertent or accidental actuation of the firing trigger. Accordingly, the firing trigger can be configured for actuation with a very low magnitude or "soft" pull without compromising safety. That is, conventional firearms require substantial pull to be actuated in order to assure that the trigger doesn't misfire during otherwise routine handling. For the disclosed embodiments, the safety trigger assures that the firearm is discharged only upon deliberate actuation of the firing trigger. In one embodiment, a trigger pull adjustment mechanism provides adjustment of the pull of the firing trigger to a desired force required by the operator. The disclosed trigger pull adjustment mechanism reduces the number of components and complexity of the machined parts over conventional trigger pull adjustment mechanisms.

In some embodiments, a firearm with a safety trigger component must be retracted prior to the firing trigger being retracted to fire the firearm, the safety trigger providing a plurality of firing inhibitors. In one embodiment, the safety trigger component includes a direct hammer catch positioned in an interfering or catch position when the safety trigger is in an unretracted position and one or more additional firing inhibitors controlled by the safety trigger. In various embodiments, a firing inhibitor controlled by the safety trigger is a sear portion block. In some embodiments, the safety trigger moves a sear blocking portion between a blocking position and a non-blocking position with respect to the sear portion. Optionally, the sear portion is part of a unitary trigger component. In some embodiments, the safety trigger controls a firing trigger block that is positioned to prevent the pivoting of the firing trigger component about the pivot axis, thus inhibiting the retraction of the firing trigger.

Structurally, various embodiments of a trigger assembly of a firearm is disclosed, the trigger assembly including passive and redundant safety mechanisms to prevent unintentional firing when the firearm is in a firing mode. In some embodiments, the trigger comprises: a hammer rotatable about a first axis, the hammer including structure defining a capture feature; a firing trigger component rotatable about a second axis and including a first finger hook portion, the firing trigger component including a sear portion releasably coupled to the hammer; and a safety trigger component rotatable about the second axis and including a second finger hook portion, the second finger hook portion extending forwardly of the first finger hook portion. In some embodiments, a first of the redundant safety mechanisms includes a catch portion defined on the safety trigger component and, when the safety trigger is in a battery position, is aligned for arresting the capture feature of the hammer as the hammer rotates to prevent discharge of the firearm. In some embodiments, a second of the redundant safety mechanisms includes a blocking member operatively coupled with the safety trigger component for maintaining the blocking member in a blocking position when the safety trigger component is in a battery position, the blocking member blocking an underside of the firing trigger component when in the blocking position to prevent release of the sear portion from the hammer, the blocking member being operatively coupled with the safety trigger component for moving the blocking member out of the blocking position by moving the safety trigger out of the battery position to enable release of the sear portion from the hammer. In one embodiment, a rearward deflection of the safety trigger component causes rotation of the blocking member.

In certain embodiments, the blocking member includes an arcuate base portion rotatable about a third axis, the arcuate base portion defining a recess and being operatively coupled with the safety trigger component for rotation about the third axis. In one embodiment, the arcuate base portion blocks the underside of the firing trigger component from being actuated when the safety trigger component is in the battery position, and the recess aligns with the firing trigger when the safety trigger component is rotated out of the battery position to enable the firing trigger to release the hammer.

In some embodiments, the blocking member includes a lever portion operatively coupled with the safety trigger component for rotation about a third axis, wherein the lever portion blocks the underside of the firing trigger component to prevent disengagement of the firing trigger component from the hammer, the lever portion being maintained in the blocking position by the safety trigger when the safety trigger is in the battery position, the lever portion being selectively rotatable out of the blocking position by rotating the safety trigger out of the battery position. Alternatively or in addition, the trigger assembly comprises a manual safety mechanism actuated by a push button forward of the first finger hook portion and laterally actuated for selectively placing the firearm in one of a safety mode and a firing mode, the manual safety mechanism being operatively coupled to the blocking member for preventing the safety trigger component from moving the blocking member out of the blocking position when in the safety mode, and enabling the safety trigger component to move the blocking member out of the blocking position when in the firing mode.

For embodiments including the fore-mentioned manual safety mechanism, the blocking member can include an arcuate base portion rotatable about a third axis, the arcuate base portion defining a recess and being operatively coupled with the safety trigger component for rotation about the third axis, wherein: the arcuate base portion blocks the underside of the firing trigger component from being actuated when the safety trigger component is in the battery position and when the firearm is in the safety mode and in the firing mode; and the recess aligns with the firing trigger when the firearm is in the firing mode and the safety trigger component is rotated out of the battery position to enable the firing trigger to release the hammer. Optionally, the lever portion that extends from the arcuate base portion of the blocking member.

In some embodiments, the blocking member includes a lever portion operatively coupled with the safety trigger component for rotation about a third axis, wherein the lever portion blocks the underside of the firing trigger component to prevent disengagement of the firing trigger component from the hammer, the lever portion being maintained in the blocking position by the safety trigger when the safety trigger is in the battery position and the firearm is in the firing mode, the lever portion being selectively rotatable out of the blocking position when the firearm is in the firing mode by rotating the safety trigger out of the battery position. In some embodiments, the lever portion contacts the firing trigger when the safety trigger is in the battery position.

In various embodiments, the firearm includes a bolt assembly translatable forwardly and rearwardly, the bolt assembly including a firing pin that is offset from the barrel axis for firing rimfire cartridges, and wherein the chamber is configured for necked cartridges. Some embodiments provide for arresting the hammer to facilitate semi-automatic operation. In various embodiments, a trigger pull adjustment mechanism is provided for adjusting a pull required to actuate the firing trigger component.

In various embodiments of the disclosure, a firearm having a fully cocked configuration and a triggered configuration is disclosed, comprising: a hammer including a sear engagement portion; a biasing element operatively coupled with the hammer that shifts the hammer from a first orientation that corresponds to the fully cocked configuration to a second orientation that corresponds to the triggered configuration; a firing trigger component including a sear portion that engages the sear engagement portion of the hammer when the trigger assembly is in the fully cocked configuration, the firing trigger component being actuatable for disengagement of the sear portion from the sear engagement portion, enabling the biasing element to shift the hammer from the first orientation to the second orientation; a safety trigger component selectively movable between a blocking position and a non-blocking position; and a blocking member that engages the safety trigger component and is moveable by the safety trigger component between a first position wherein the blocking member prevents actuation of the firing trigger component when the safety trigger component is in the blocking position and a second position wherein the blocking member enables actuation of the firing trigger component when the safety trigger component is in the non-blocking position.

The safety trigger component can optionally comprise a catch that prevents the hammer from reaching the second orientation from the first orientation when the safety trigger component is in the blocking position. The manual safety mechanism can include a safety bar accessible from outside the housing. In some embodiments, a housing contains the hammer and the biasing element, wherein the blocking member is selectively engageable with the housing to prevent the safety trigger component from moving the blocking member. The blocking member can operatively coupled with a manual safety mechanism that selectively engages the blocking member with the housing. The firing trigger component can be actuatable by rotation about a pivot, the pivot being operatively coupled with the housing.

In various embodiments of the disclosure, a semiautomatic firearm is presented having a fire trigger with a curvature and a central slot and a safety trigger disposed in the slot and having a curvature conforming to the curvature of the fire trigger, the fire trigger having a normal position and a fire position rearward of the normal position, the safety trigger having a normal position extending forwardly of the normal position of the fire trigger, and a fire position at or rearwardly of the normal position of the fire trigger, the safety trigger associated with at least two firing inhibitors, the firing inhibitors in a inhibiting position when the safety trigger is in the normal position and in a non-inhibiting position when the safety trigger is in the fire position.

Various embodiments of the disclosure include a hammer that pivots about a pivot axis and has capture features on opposing sides. In some embodiments, the hammer includes a first engagement portion that operates as a hammer to prevent the hammer release unless a safety trigger is retracted, and the hammer includes a second engagement portion as an arrestor that prevents automatic firing action and captures the hammer should the firing trigger remain retracted during a recoil cycle.

Some embodiments of the disclosure include a semiautomatic firearm suitable for high powered rimfire cartridges that incorporates a trigger assembly with a plurality of firing inhibitors to minimize misfires and out-of-breach firings of cartridges and that still allows for a low pressure trigger pull that can be adjusted by the user, for example, field adjustable.

Some embodiments disclose a semiautomatic firearm having a fire trigger with a curvature and a central slot and a safety trigger disposed in the slot and having a curvature approximating the curvature of the fire trigger, the safety trigger being connected to a plurality of firing inhibitors that each have an inhibiting position and a non-inhibiting position.

In various embodiments, a semiautomatic firearm is disclosed having a fire trigger with a curvature and a central slot and a safety trigger disposed in the slot and having a curvature substantially conforming to the curvature of the fire trigger, the fire trigger having a battery position and a fire position rearward of the battery position, the safety trigger also having a battery position extending forwardly of the battery position of the fire trigger, and a fire position at or rearwardly of the battery position of the fire trigger, the safety trigger associated with at least two fire inhibitors, the fire inhibitors being in an inhibiting position when the safety trigger is in the battery position and in a non-inhibiting position when the safety trigger is in the fire position.

DETAILED DESCRIPTION

Figure 1:
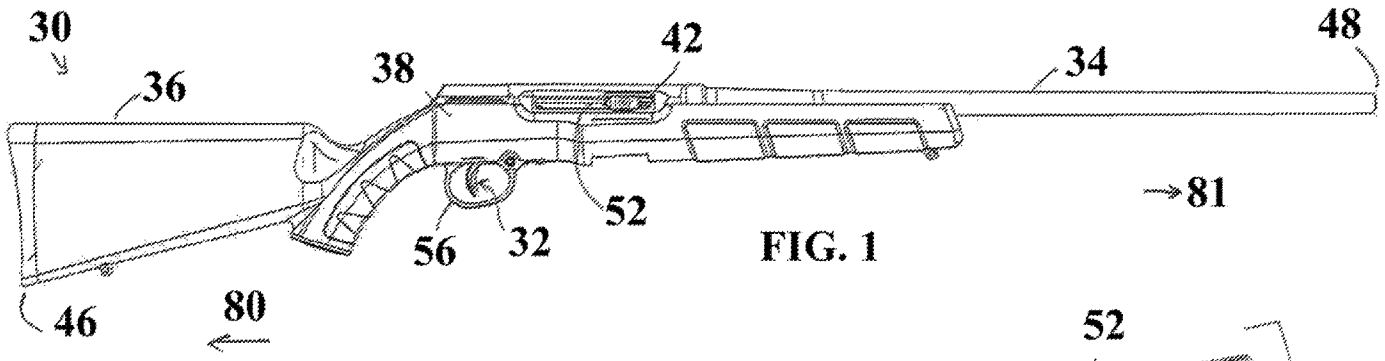
FIG. 1 is a side elevational view of a firearm in an embodiment of the disclosure.

Referring to FIGS. 1-6, a firearm 30 generally comprises a trigger assembly 32, a barrel 34 mounted in a stock 36 and connecting to a receiver 37. A firearm housing 38 formed of the receiver 37 and stock in this embodiment, engages and extends rearwardly from the barrel 34 and houses a breech 42 and the trigger assembly 32. The breech 42 is above and forward of the trigger assembly 32 and rearwardly of the barrel. The barrel 34 has a body portion with a smaller outer diameter male threaded portion 40 defining a firing chamber 41 concentric about a barrel axis 43, the male threaded portion 40 threadably engaging with a female threaded portion 42 of the receiver 37. In one embodiment, the chamber is configured for necked cartridges, such as the .17 HSR and .17 WSM. A locking nut 44 can threadably engage a larger outer diameter threaded portion 46 of the barrel and tighten against the forward end 48 of the receiver 37.

A bolt assembly 52 is slidingly engaged within the receiver 37 and includes a cartridge retraction mechanism 51, and a manual handle 56. A cycling spring assembly 55 connects between the bolt assembly and the rearward end 57 of the trigger assembly. A trigger guard 56 extends from the housing 38.

Figure 5A:
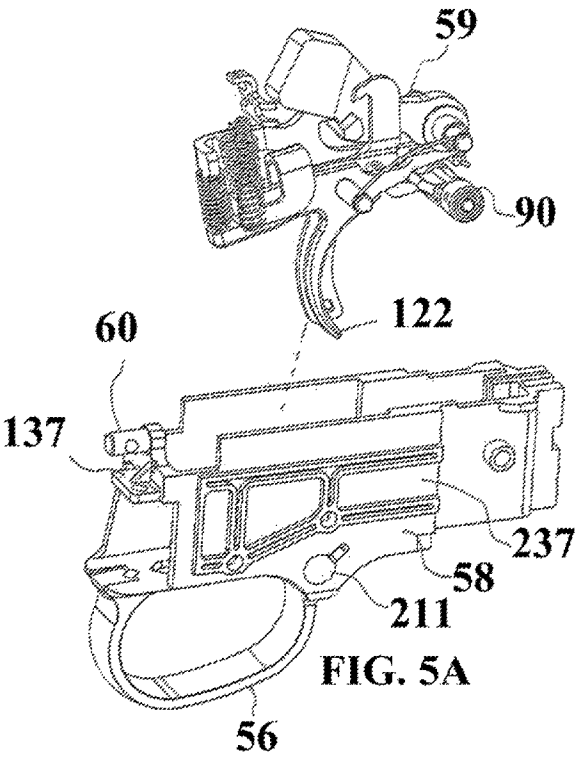
FIG. 5A is an exploded view of the trigger assembly of FIG. 3 with trigger component cluster depicted as removed from a trigger mechanism housing.

The trigger assembly 32 is depicted in detail and various views throughout the figures. The trigger assembly 32 is housed within the firearm housing 38 comprising primarily the stock 36. The trigger assembly 32 has a trigger mechanism housing 58 which receives a trigger component cluster 59 as best shown in FIG. 5A. The trigger component cluster 59 are generally movable components and pivot about shafts that are supported by the firearm housing 38. The cluster 59 is depicted in various views without the housing 38 for purposes of clarity. The firearm housing 38 is advantageously formed from injection molding polymers and may have specific metal inserts therein for reinforcement, for example at the rearward projection 60 that is inserted in a cooperating aperture 61 in the rearward end of the receiver 37.

Referring to FIGS. 5A-12, within the trigger mechanism housing 58, the trigger component cluster 59 generally includes a hammer 82, a firing trigger component 84, a safety trigger component 86, an arrestor 88, and a manual safety mechanism 90. The hammer 82 includes a head portion 92 and a cam portion 94 having separated by a stem portion 96. The cam portion 94 defines an aperture 98 that is mounted to and rotates about a bushing 100 and shaft 101 to define a hammer pivot 102 that actuates about a rotational axis 104. In one embodiment, the cam portion 94 further includes an arcuate cam surface 105 and a sear engagement portion 106, the sear engagement portion 106 having a radially extending bearing face 108. The cam portion 94 can also define a flat 110 that extends at an angle θ from the bearing face 108. In one embodiment, the angle θ is an obtuse angle. The hammer 82 is also coupled with a biasing element 112 which, in some embodiments, is a rotational spring 114 (FIGS. 11 and 14-22) that is rotated about and coupled to the hammer pivot 102 with the free ends engaged, for example, with the trigger mechanism housing 58. The hammer 82 can also include a capture feature 116. In various embodiments, the capture feature 116 includes an engagement surface 115. A squared loop 117 in the rotational spring 114 can provide space at the projection for engagement of the projection with the safety trigger component, discussed below.

As best seen in FIGS. 6, 7, 8, 9, and 12, the firing trigger component 84 includes a finger hook portion 122 and a sear portion 124, the sear portion 124 having a sear surface or cam engagement surface 140 cooperating with and being configured to engage the sear engagement portion 106 and cooperating surface 108 of the hammer 82. The firing trigger component 84 can be mounted to a trigger pivot 126 configured as a shaft or pin and defining a rotational axis 128 and extending from the trigger mechanism housing 58 along the rotational axis 128. In some embodiments, the firing trigger component 84 further defines a slot 132 that extends into the finger hook portion 122 and lies on a plane that is substantially perpendicular to the rotational axis 128. The firing trigger component 84 can also include an extended portion 134 that is engaged with a firing trigger return spring 136 that biases finger hook portion 122 of the firing trigger component 84 in the forward direction 81. The return spring 136 may be engaged with a ledge or flange portion 137 of the trigger mechanism housing (FIGS. 4, 5A, 5B, 6, and 8).

In some embodiments, the firing trigger component 84 includes a cam engagement surface 140 that engages the arcuate cam surface 105 of the hammer 82.

The safety trigger component 86 can include a finger hook portion 142 and can be pivotally mounted to the trigger pivot 126. In various embodiments, the finger hook portion 142 of the safety trigger component 86 is a flat structure, formed from, for example, sheet or plate, that is disposed in the slot 132 of the finger hook portion 122 of the firing trigger component 84. The finger hook portion 122 of the safety trigger component 86 can also include an aperture 144. The aperture 144 can be utilized for insertion of a pin or lock, effectively preventing movement of the trigger hook portion particularly with respect to the hook portion of the firing trigger component. As discussed further below, this prevents the firing trigger component 84 from being actuated.

Figure 2:
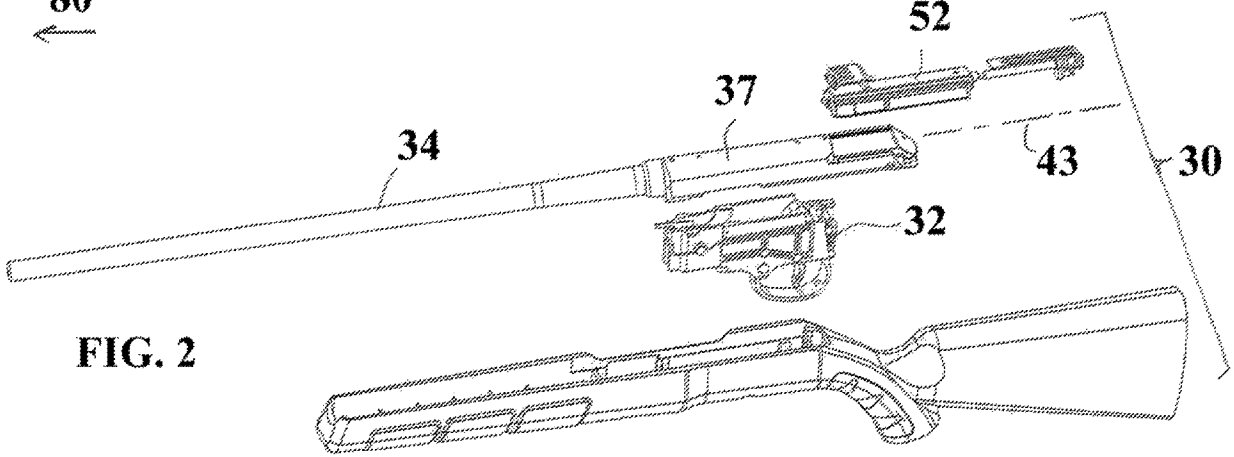
FIG. 2 is an exploded view of the firearm of FIG. 1.
Figure 3:
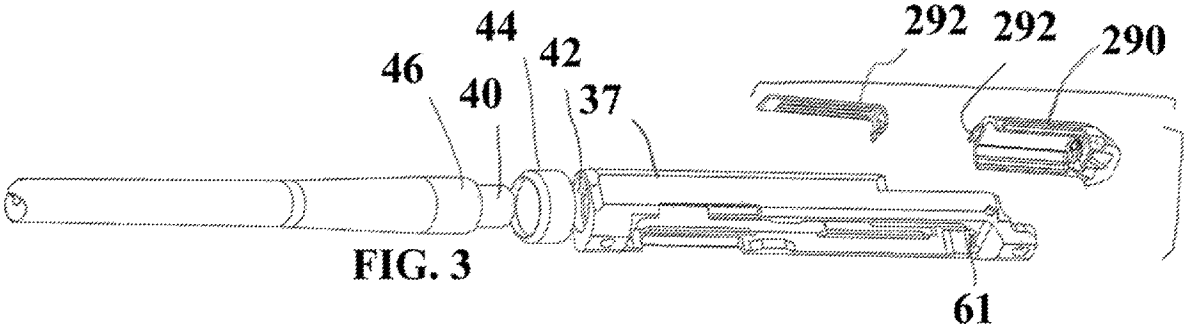
FIG. 3 is an exploded view of receiver and barrel of the firearm of FIG. 1.
Figure 4:
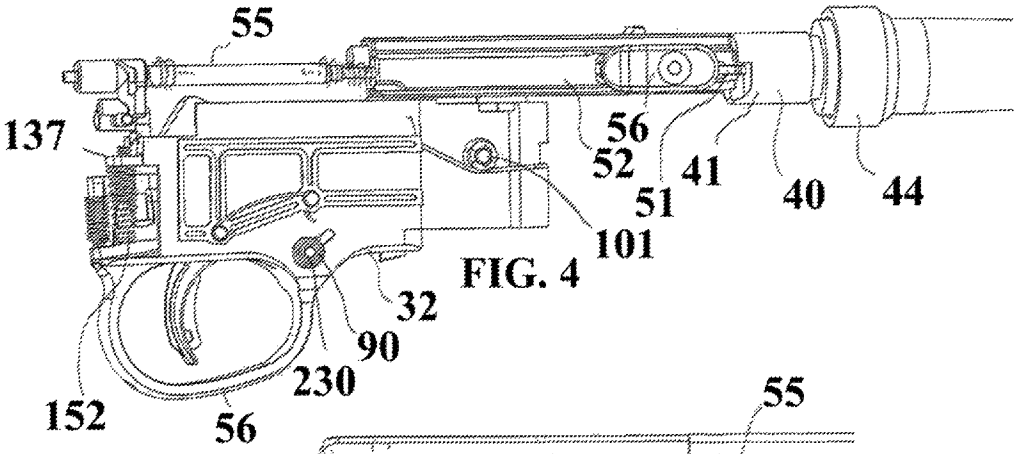
FIG. 4 is a detail view of the trigger assembly, bolt assembly, chamber, and barrel of a firearm with the receiver removed in an embodiment of the disclosure.

In one embodiment, the safety trigger component 86 includes a catch portion 146 that is laterally adjacent to the hammer 82. The catch portion 146 can resemble an inverted "J" shape, for example as depicted in FIGS. 2 and 3. The safety trigger component 86 can also include an extended portion 148 that is engaged with a safety trigger component return spring 152. The return spring 152 is attached to the ledge portion 137 of the trigger mechanism housing configured as a ledge. In one embodiment, the extended portion 148 of the safety trigger component 86 includes an arm 154 that extends out of the slot 132 and wraps over and partially around the extended portion 134 of the firing trigger component 84, as best seen in FIGS. 5A, 7, 8, and 9. A spring receiving member 155 shaped as a projection receives the safety trigger return spring 152.

Functionally, the safety trigger component return spring 152 exerts a return force on the extended portion 148 of the safety trigger component 86 urging the finger hook portion 142 of safety trigger component 86 to be rotated to a full forward position within the slot 132 of the firing trigger component 84. In this unactuated or default orientation, the catch portion 146 is positioned so that the catch portion 146 is in a rotational path 162 (FIG. 14) through which the capture feature 116 of the hammer 82 travels during firing and obstructs the hammer 82. Accordingly, the catch portion 146 intercepts the capture feature 116 of the hammer 82 if the catch portion 146 of safety trigger component 86 has not first been rotated out of the rotational path 162. Hence, the safety trigger component 86 provides an additional safety mechanism that helps prevent discharge of the firearm 30 in the event of an unintentional release of the hammer 82—for example, during an impact event where the weapon becomes jarred to the extent that the sear portion 124 of the firing trigger component 84 slips off the sear engagement portion 106 of the hammer 82.

During such an impact event, the safety trigger component 86 may undergo rotational displacement that is commensurate with the rotational displacement of the firing trigger component 84. However, in various embodiments, the rotational displacement required to rotate the catch portion 146 out of the rotational path 162 of the capture feature 116 of the hammer 82 is substantially greater than the rotational displacement required for the sear portion 124 of firing trigger component 84 to disengage the sear engagement portion 106 of the hammer 82 (see discussion below). Accordingly, the safety trigger component 86 will generally still perform the function of intercepting the hammer 82 even if the safety trigger component 86 undergoes the same or even somewhat more rotational displacement than the firing trigger component 84 in an impact event.

In the depicted embodiments, the capture feature 116 is a lateral projection that extends laterally outward from the hammer 82 in a direction parallel to the rotational axis 104, for capture by the inverted "J" or other concavity defined by the catch portion 146. In other embodiments, the capture feature 116 can comprise a notch formed in the hammer 82, and the catch portion 146 can include a projection that is captured within the notch (not depicted).

Figure 13:
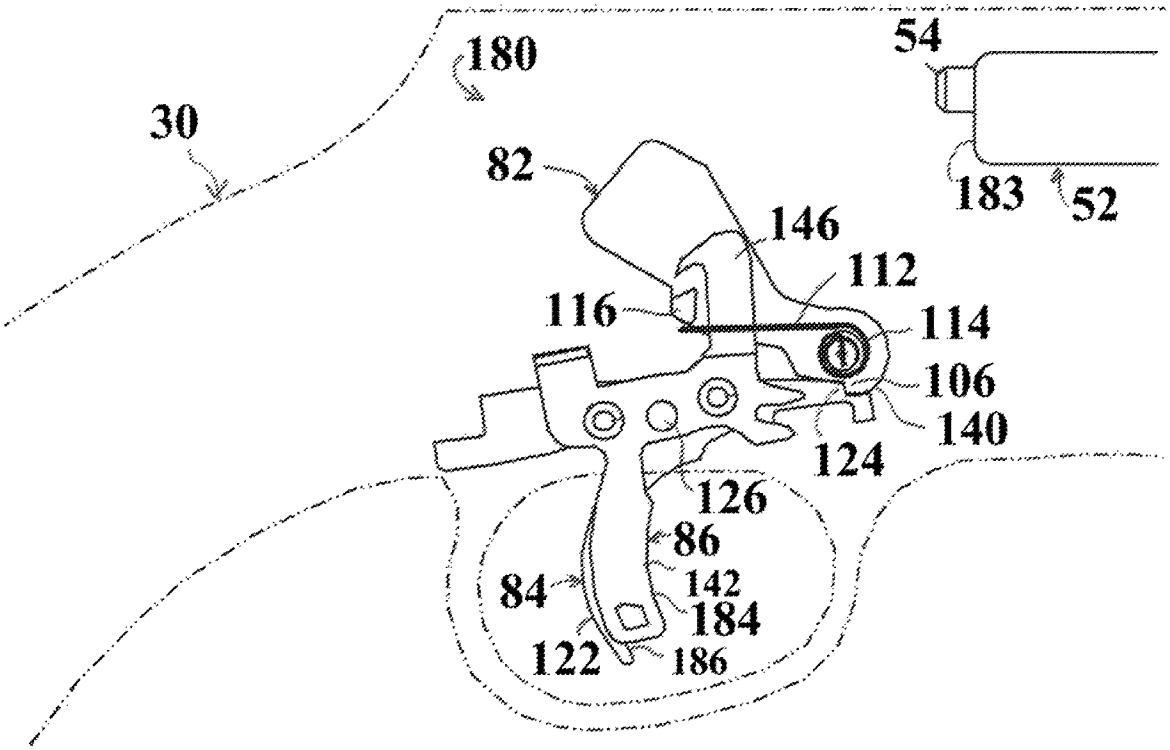
FIG. 13 is a side elevation schematic view of trigger assembly components in a battery position, illustrating a cocked configuration of a firing sequence, where a firing trigger and a safety trigger are in a battery position in an embodiment of the disclosure.
Figure 14:
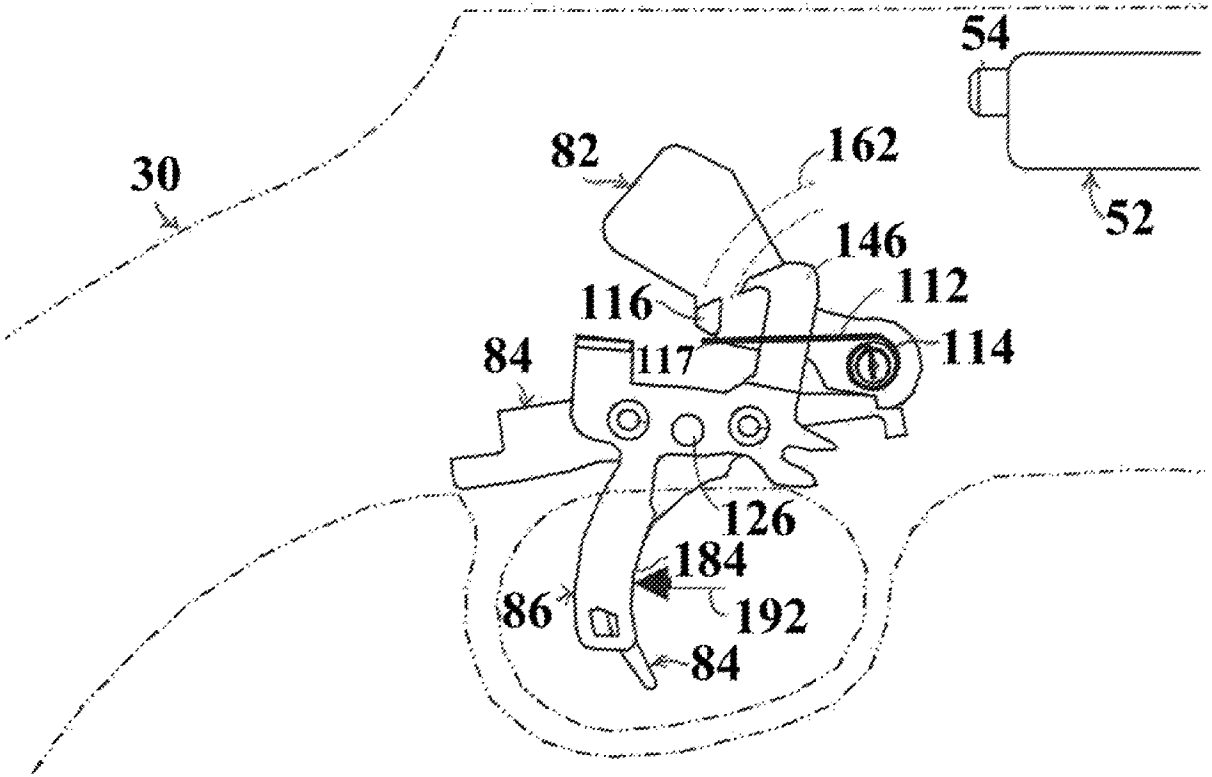
FIG. 14 is the trigger assembly components of FIG. 13 in an enabled configuration of a firing sequence, where the firing trigger is in a battery position and the safety trigger rotated out of the battery position in an embodiment of the disclosure.
Figure 15:
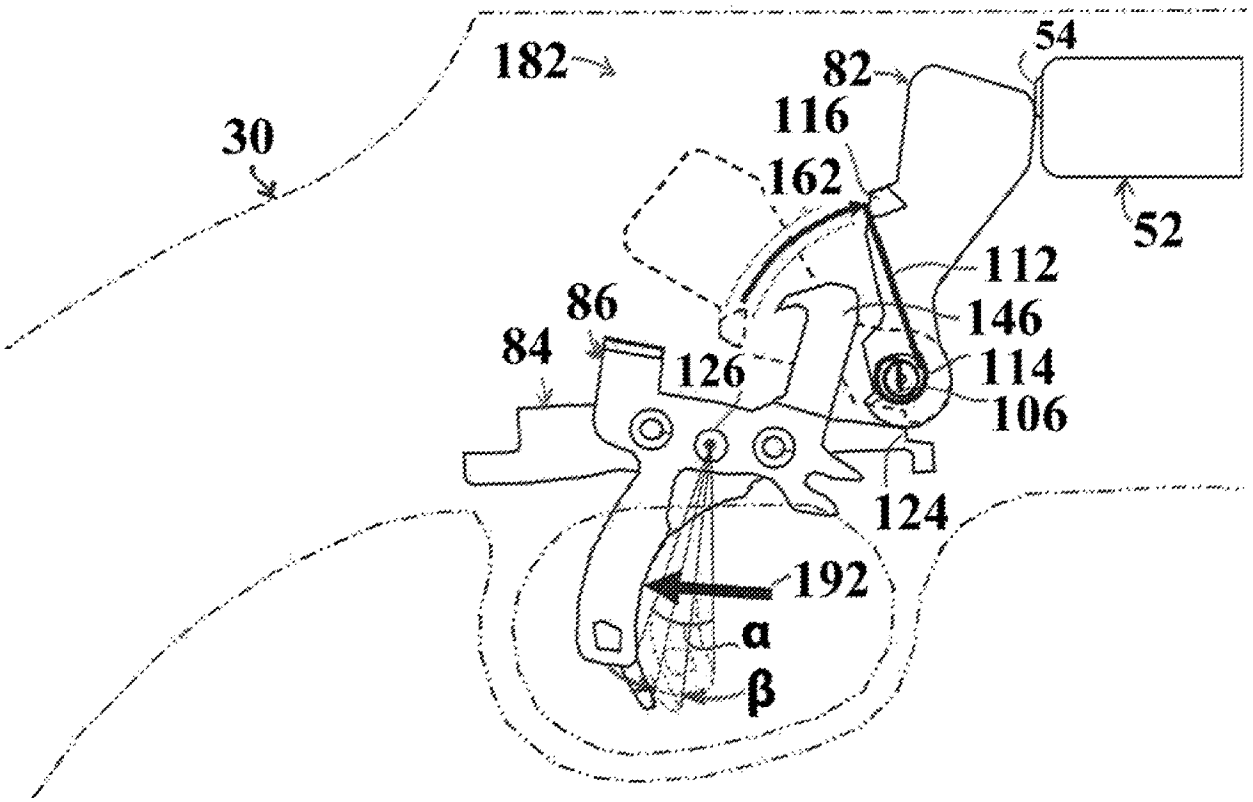
FIG. 15 is the trigger assembly components of FIG. 13 in a fired configuration of a firing sequence, where the safety trigger and the firing trigger are in a firing position in an embodiment of the disclosure.

Referring to FIGS. 13 through 15, an operation sequence of the hammer 82, the firing trigger component 84, the safety trigger component 86, and the bolt assembly 52 from a fully cocked configuration 180 to a triggered configuration 182 is depicted in one embodiment of the disclosure. The FIGS. 13-16 depict the hammer 82, firing trigger component 84, and safety trigger component 86 at a mid-plane of the slot 132, with various appurtenances removed for clarity of illustration.

Figure 6:
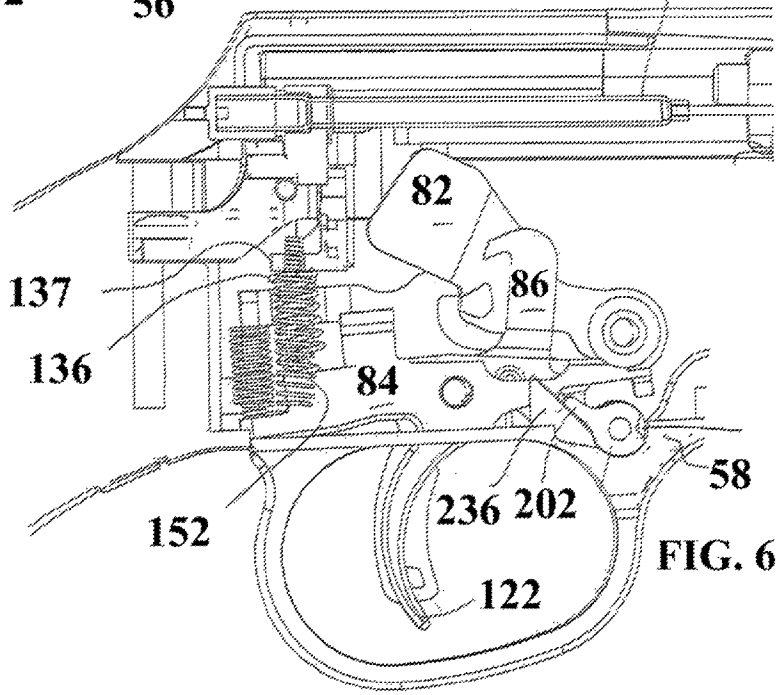
FIG. 6 is an elevational view of a firearm with the stock and trigger assembly housing removed in an embodiment of the disclosure.
Figure 5B:
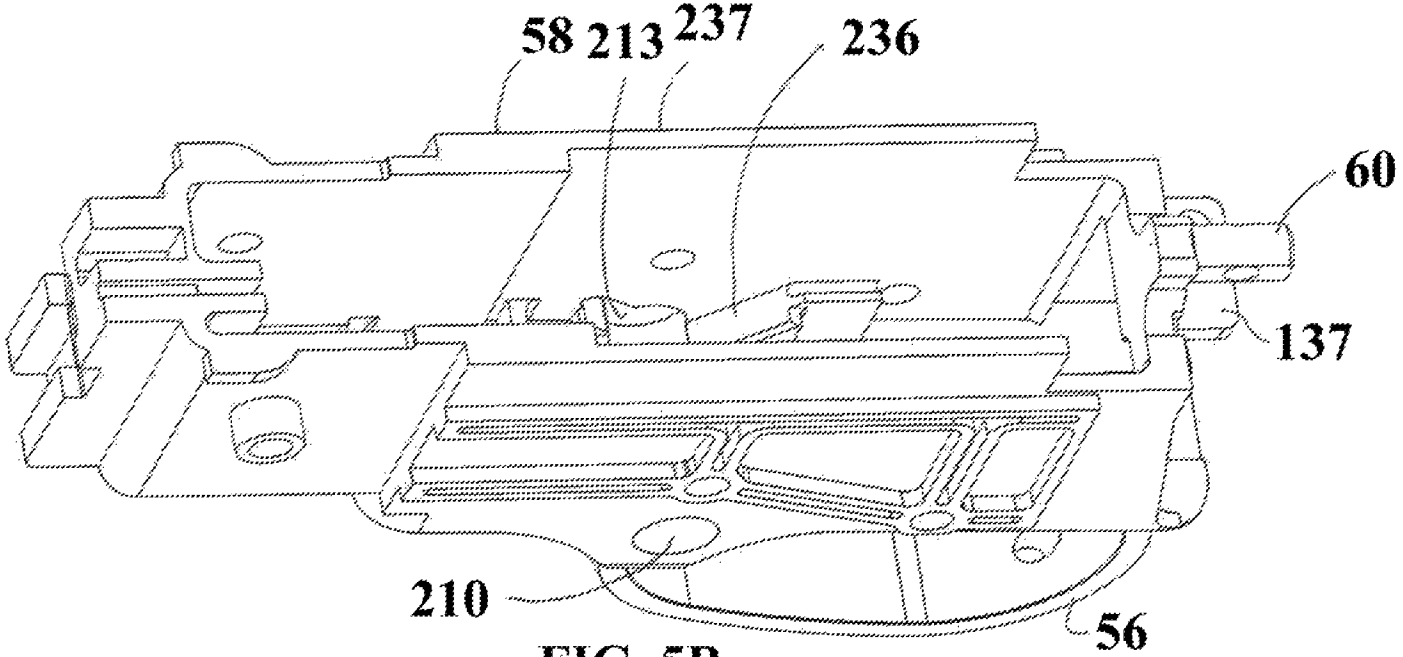
FIG. 5B is a top perspective view illustrating the interior of the trigger mechanism housing of FIG. 5A.
Figure 7:
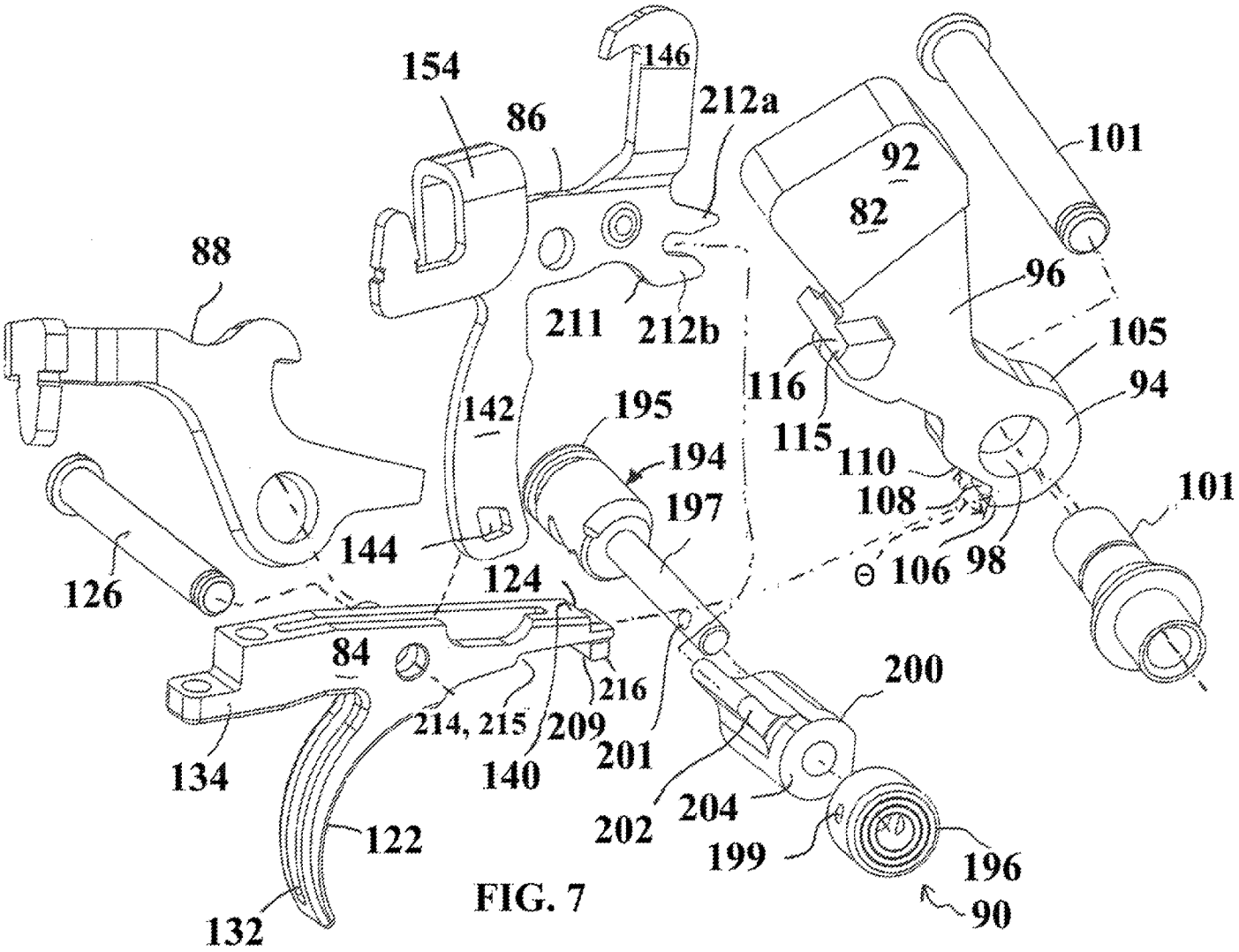
FIG. 7 is an exploded view of principal components of the trigger assembly in an embodiment of the disclosure.
Figure 8:
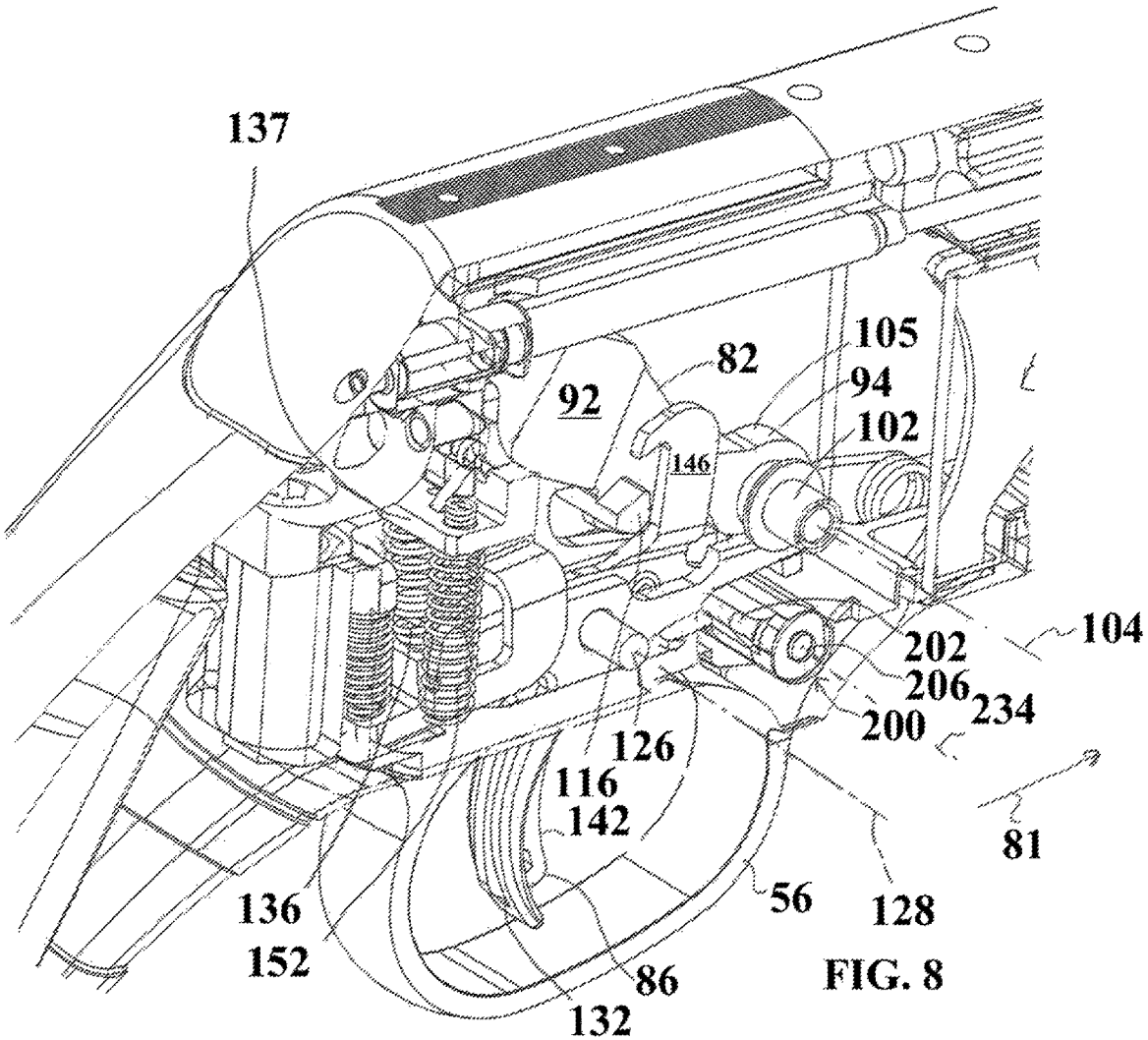
FIG. 8 is a rear cutaway perspective view of the stock and trigger assembly of FIG. 6 with portions of the stock and trigger mechanism housing removed for illustration.
Figure 9:
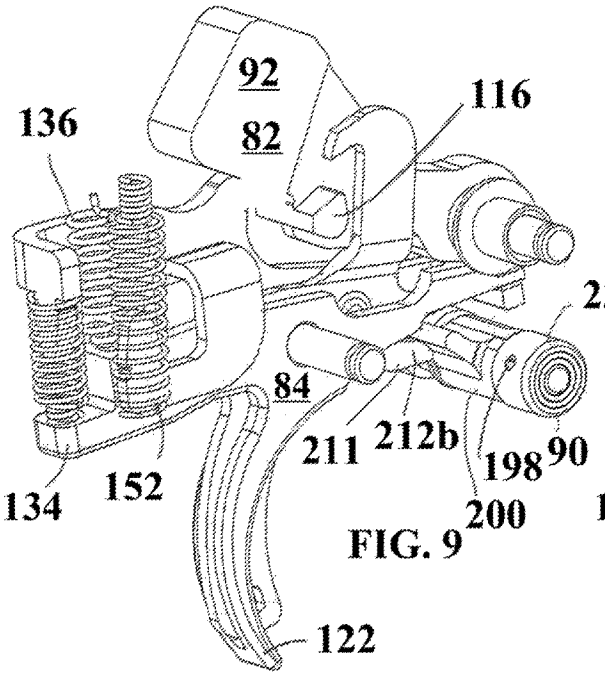
FIG. 9 is a forward looking right side perspective view of the principal components of the trigger assembly of FIG. 6 in isolation.
Figure 11:
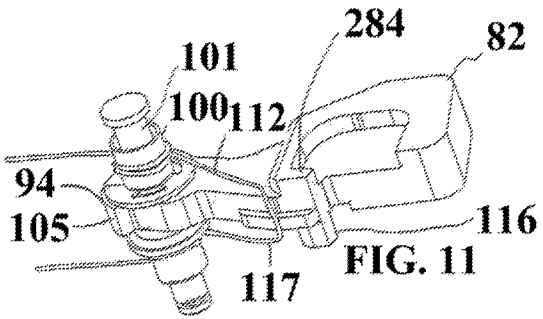
FIG. 11 is a upwardly looking perspective view of the hammer assembly in isolation with the hammer spring extended.

In the fully cocked or "battery" configuration 180 (FIG. 13), the sear portion 124 of the firing trigger component 84 is in forced engagement with the sear engagement portion 106 of the hammer 82, the forced engagement being exerted by the biasing element 112. The respective finger hook portions 122 and 142 of the firing trigger component 84 and the safety trigger component 86 are held in a forward most orientation by the respective return springs 136 and 152 (FIGS. 6, 8, 9). In the fully cocked configuration 180, the bolt assembly 52 is also in a firing position within the breech 42, with a firing pin 54 exposed and outwardly extending relative to a rearward end 183 of the bolt assembly 52. In one embodiment, the firing pin 54 is substantially parallel to but offset from the barrel axis 43 to facilitate firing of rimfire cartridges. Also in the fully cocked configuration 180, a front edge 184 of the safety trigger component finger hook portion 142 extends distal to a front edge 186 of the firing trigger component finger hook portion 122.

An actuation force 192 is applied to the front edge 184 of the safety trigger component finger hook portion 142 (FIG. 14), for example by a squeezing motion applied by a finger of a user. The actuation force 192 causes the safety trigger component 86 to rotate about the trigger pivot 126, so that the catch portion 146 is rotated out of the rotational path 162 of the capture feature 116, thereby clearing the hammer 82 for an unobstructed rotation to the firing pin 54. In the FIG. 14 depiction, the safety trigger component 86 is progressing toward a firing position, while the firing trigger is in a battery position.

The actuation force 192 then engages the firing trigger component 84, thereby causing the firing trigger component 84 and the safety trigger component 86 to rotate effectively simultaneously about the trigger pivot 126 and into firing positions. The rotation of the firing trigger component 84 causes the sear portion 124 to rotate away from the hammer 82 and slide radially outward from the hammer pivot 102 along the sear engagement portion 106. When the sear portion 124 slides off the sear engagement portion 106, the hammer 82 is released and swings into contact with the firing pin 54, thereby establishing the triggered configuration 182 where both the safety trigger component 86 and the firing trigger component 84 are in a firing position (FIG. 15).

The positions of respective finger hook portions 122 and 142 of the firing trigger component 84 and the safety trigger component 86 for both the fully cocked configuration 180 and the triggered configuration 182 are presented in FIG. 15, with the positions from the fully cocked configuration 180 being presented in phantom. Angular displacements $\alpha$ and $\beta$ of the safety trigger component 86 and the firing trigger component 86, respectively, are also overlaid onto FIG. 15. By this illustration and for this embodiment, the angular displacement $\alpha$ of the safety trigger component 86 in transitioning from the fully cocked configuration to the triggered configuration is about three times greater than the angular displacement $\beta$ of the firing trigger component 84. As such, the safety trigger component 86 will generally still perform the function of intercepting the hammer even if the safety trigger component 86 undergoes the same or even somewhat more rotational displacement than the firing trigger component 84 in an impact event.

Figure 16:
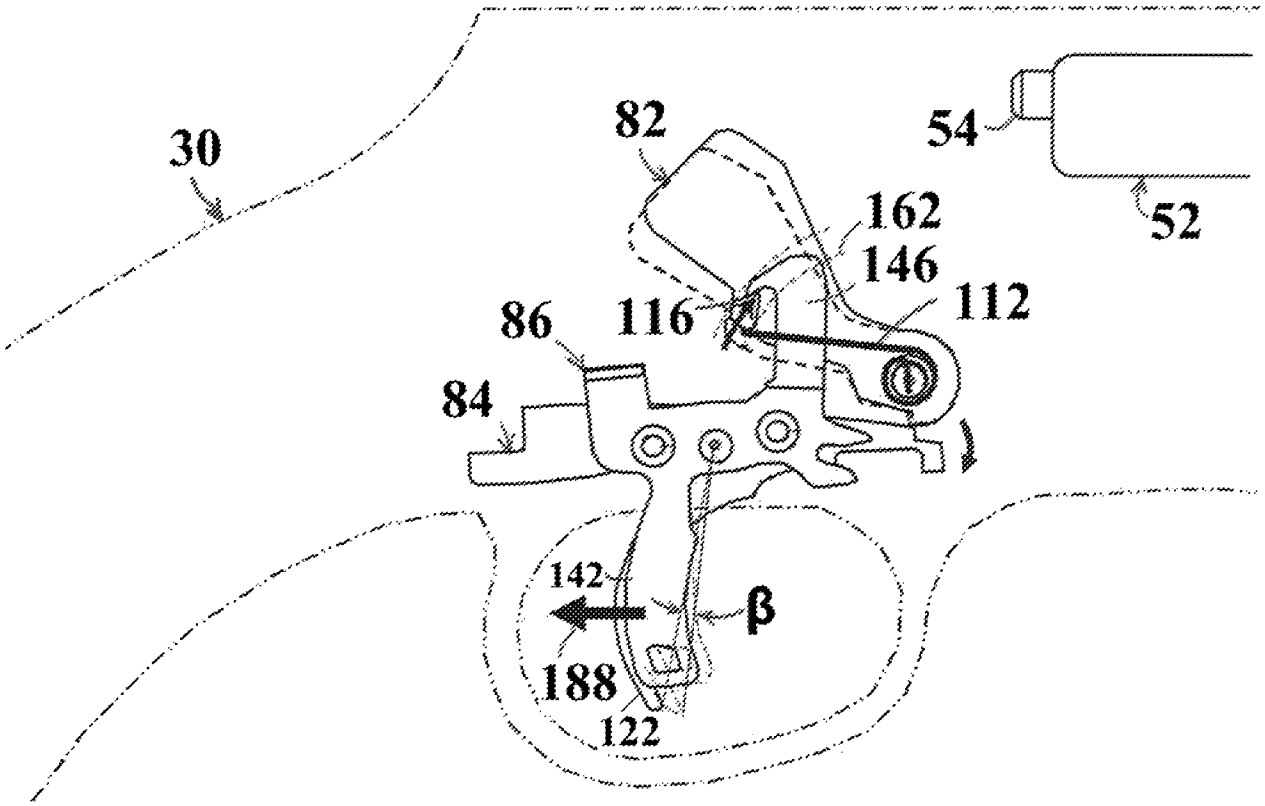
FIG. 16 is the trigger assembly components of FIG. 13 where a firing trigger and a safety trigger are in a battery position and the safety trigger catches the hammer to prevent firing in an embodiment of the disclosure.

Referring to FIG. 16, the functionality of the safety trigger component 86 during an abnormality such as an impact event is further illustrated in an embodiment of the disclosure. Consider an impact event where inertial forces cause a dynamic load 188 on the respective finger hook portions 122 and 142 of the firing trigger component 84 and the safety trigger component 86, such that both finger hook portions 122 and 142 are rotationally displaced by the angular displacement $\beta$ required to release the hammer 82. At the angular displacement $\beta$, the catch portion 146 is still operational within the rotational path 162 of the capture feature 116, and still functions to arrest the hammer 82 and prevent discharge of the firearm 30.

Referring again to FIGS. 4 through 10, and 12, the trigger assembly 32 includes the manual safety mechanism 90 conventionally positioned forward of the firing trigger. The safety mechanism 90 includes a safety bar 194 with exposed push buttons 195, 196 on each end, a shaft 197 integral with one of the push buttons 195, 196 for aligning and securing the safety mechanism components together, and a rotatable blocking member 200. A pin 198 may extend through apertures 199, 201 in the shaft 197 and end button 196 to secure the manual safety mechanism 90. The blocking member 200 can include a lever portion 202 that projects radially outward from an arcuate base portion 204. The arcuate base portion 204 rotates freely about a blocking member pivot 206 defined by the shaft 197. In one embodiment, a notch or recess 208 is formed on the arcuate base portion 204 to provide a non-blocking position for an engagement tab 209 proximate the sear portion 124 of the trigger component. The manual safety mechanism 90 is laterally slidable within the trigger mechanism housing 58 in apertures 210, 213 on opposing sides of the housing 58.

The safety trigger component 86 can include a fork 211 comprising a pair of protrusions 212*a* and 212*b* that contact the blocking member 200. The firing trigger component 84 can include an underside 214 against which the lever 202 of the blocking member 200 registers. In the depicted embodiment, the underside 214 defines a recess 215 within which the lever 202 registers The firing trigger component 84 can further include a projection 216 that is proximate the arcuate base portion 204 of the blocking member 200.

Figure 17:
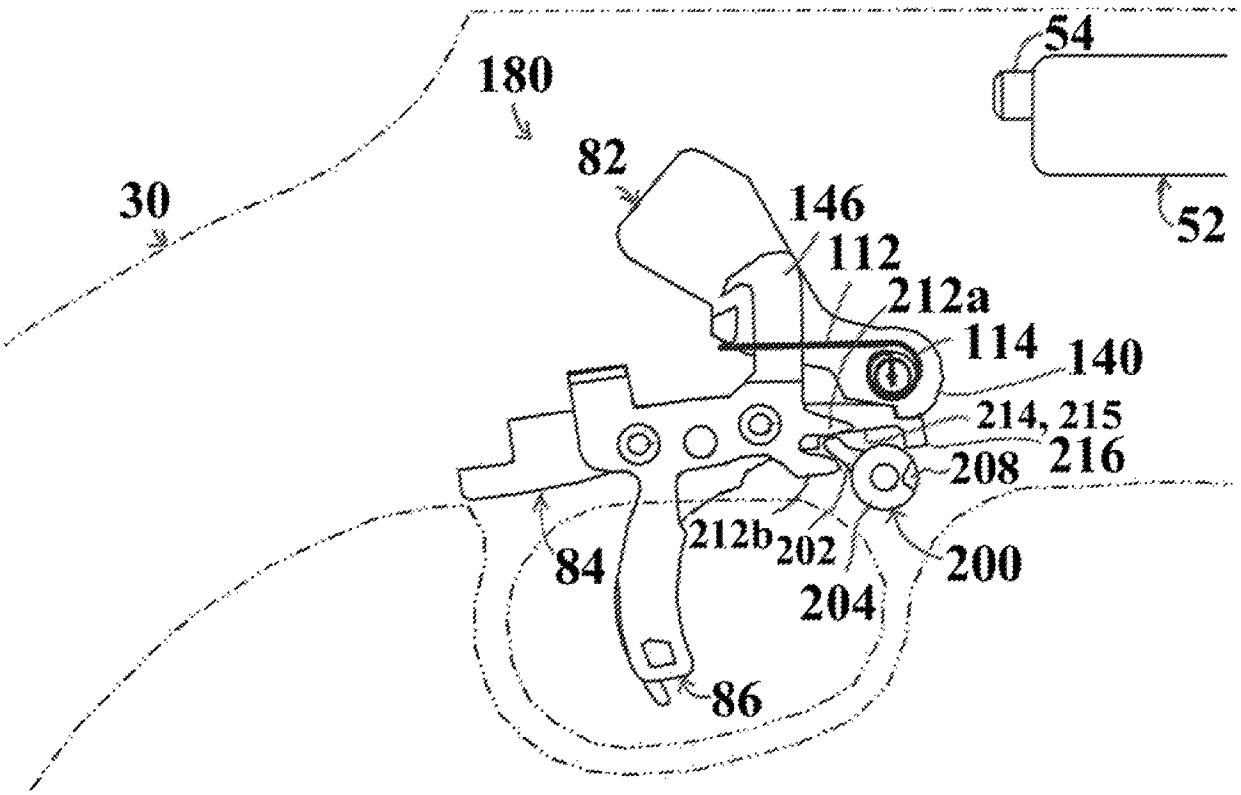
FIGS. 17-19 are a side elevation schematic views of the trigger assembly components and the operation of a blocking member during the firing sequence of FIGS. 13-15 in an embodiment of the disclosure.
Figure 18:
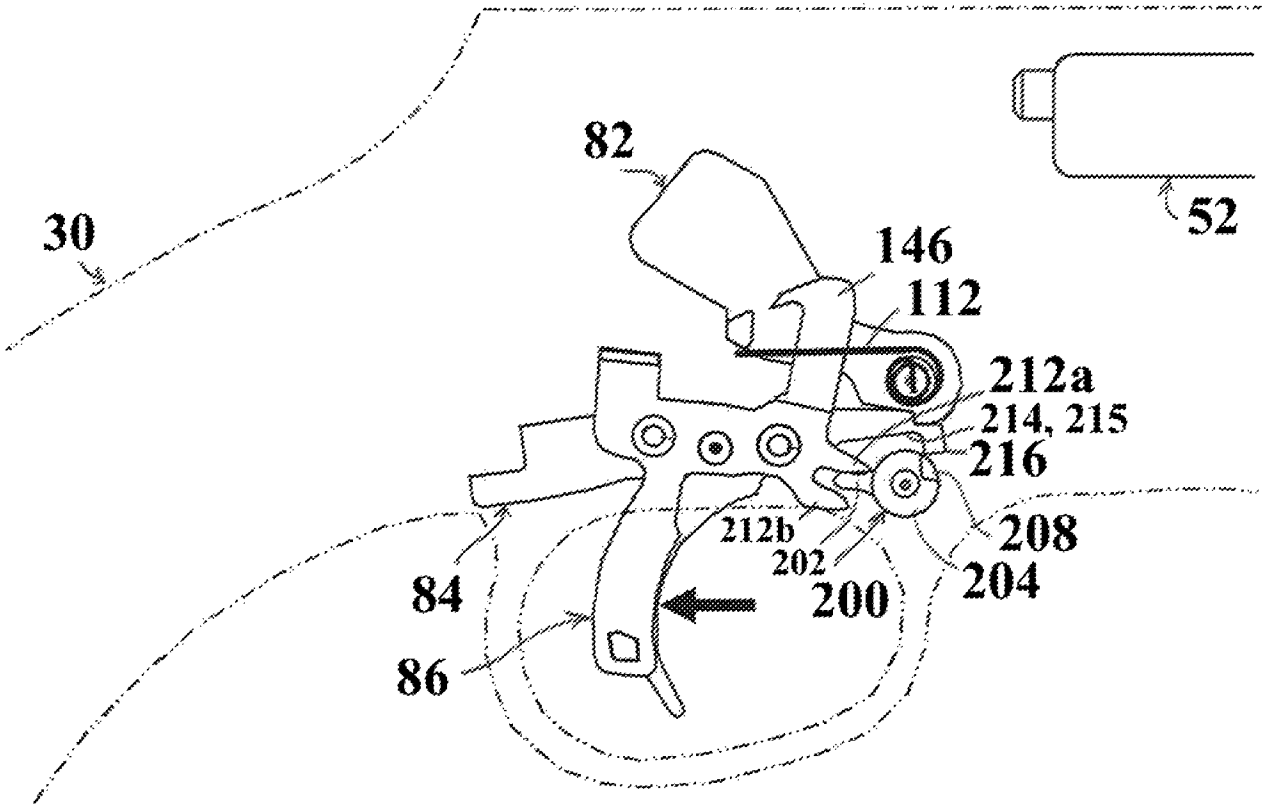
Figure 19:
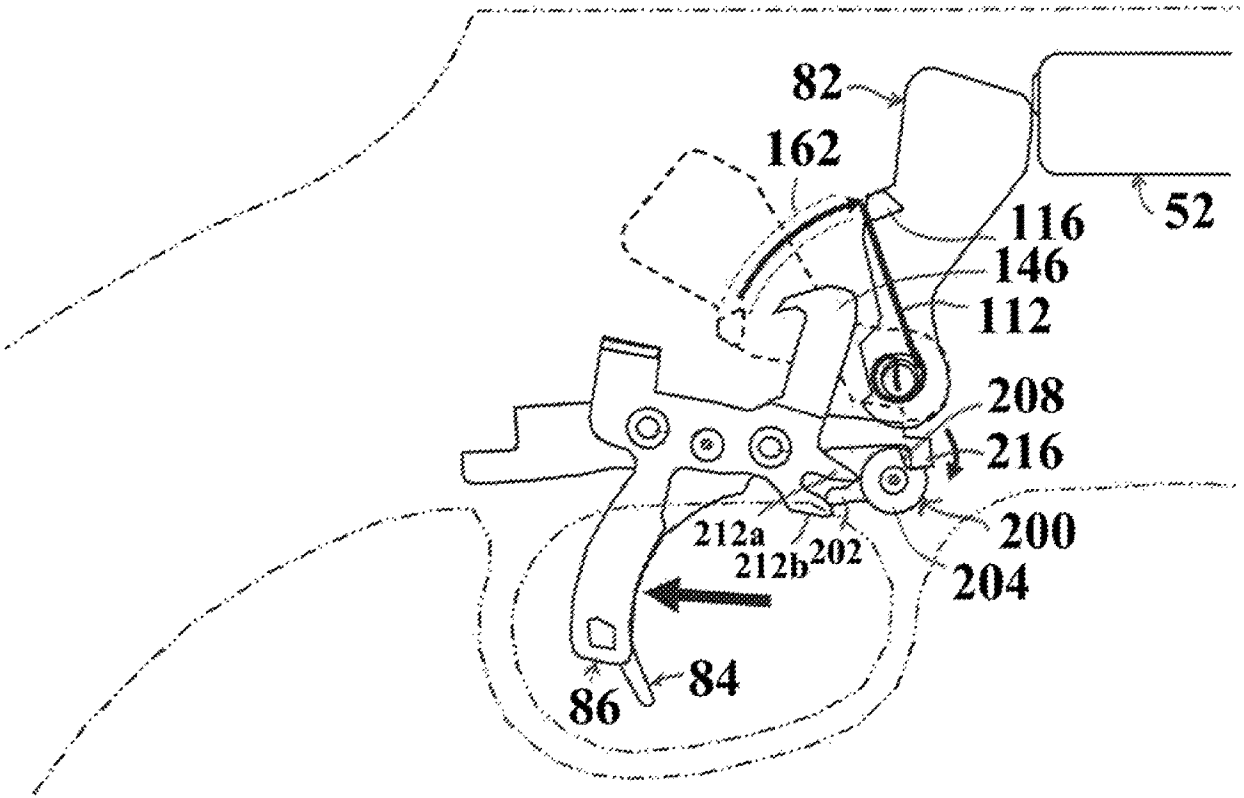

Referring to FIGS. 17 through 19, operation of the blocking member 200 during discharge of the firearm 30 is depicted in an embodiment of the disclosure. In the fully cocked configuration 180 (FIG. 9), the lever portion 202 of the blocking member 200 extends between the protrusions 212*a* and 212*b* and is engaged or nearly engaged within the underside 214 of the firing trigger component 84. The protrusion 212*b* of the safety trigger component 86 maintains the blocking member 200 in engagement/near engagement with the firing trigger component 84, thereby preventing the firing trigger component 84 from rotating away from the hammer 82. Also in the fully cocked configuration 180, the arcuate base portion 204 of the blocking member 200 can also interfere with the projection 216 of the firing trigger component 84, further preventing actuation of the firing trigger component 84.

Figure 10:
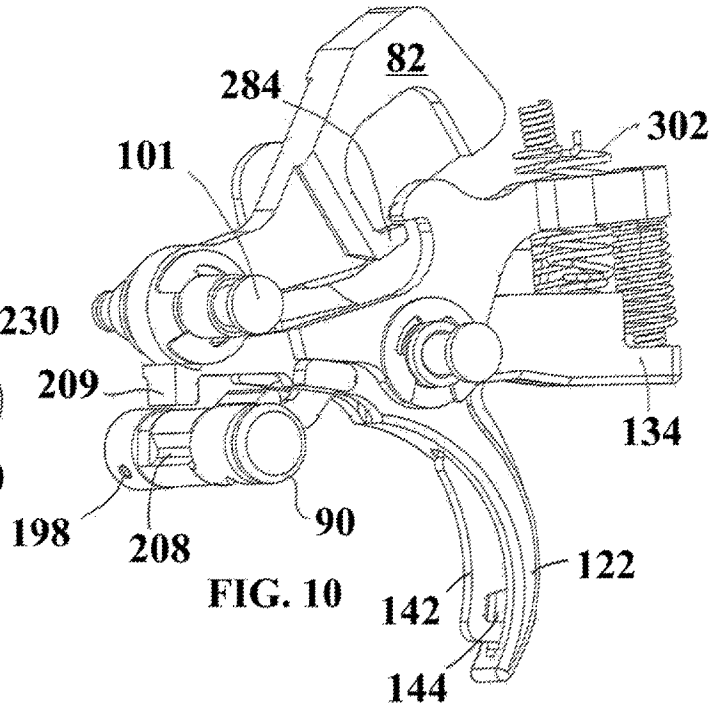
FIG. 10 is a rearwardly looking left side perspective view of the principal components of the trigger assembly of FIG. 6 in isolation.
Figure 12:
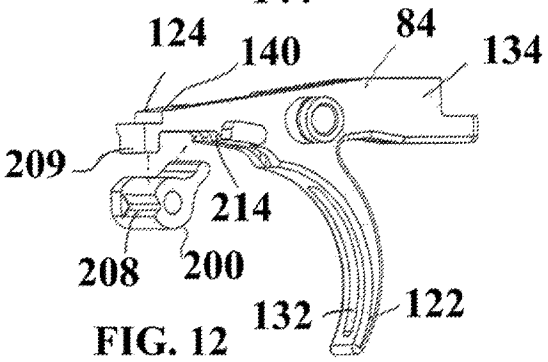
FIG. 12 is a perspective view of a hammer, a shaft, a bushing, and a rotational spring in assembly in an embodiment of the disclosure.

During actuation of the safety trigger component 86, the protrusion 212*a* rotates against blocking member 200, causing the lever portion 202 to rotate away from the underside 214 of the firing trigger component 84. The rotation of the blocking member 200 also causes the recess 208 of the arcuate base portion 204 to rotate into alignment with the projection 216 of the firing trigger component 84 (FIG. 10). During continued actuation of the safety trigger component 86 and subsequent actuation of the firing trigger component 84, the lever portion 202 has now been removed as an obstacle to rotation of the firing trigger component 84 (FIG. 11), and the recess 208 now accommodates the projection 216 of the firing trigger component.

Accordingly, when the firearm 30 is in the fully cocked configuration, the safety trigger component 86 controls the orientation of the blocking member 200. As the safety trigger component 86 is actuated, the blocking member 200 is oriented so as not to pose an obstruction to the firing trigger component 84, freeing the firing trigger component 84 for rotation away from the hammer 82 and subsequent discharge of the firearm 30.

Functionally, in the fully cocked configuration 180, if an actuation force or "pull" is exerted on the firing trigger component 84 but somehow not exerted on the safety trigger component 86, the blocking member 200 will maintain engagement with the firing trigger component 84, thereby preventing rotation of the firing trigger component 84 and subsequent discharge of the firearm 30. Thus, in one embodiment, the blocking member 200 can provide a redundant or additional safety mechanism against accidental discharge of the firearm 30. Instead of relying solely on the friction between the sear portion 124 and the sear engagement portion 106, the blocking member 200 provides a positive blocking force that helps prevent disengagement of the sear and the sear engagement portions 124 and 106 in an impact event. Moreover, the lever portion 202 engaging the recess in the trigger component prevents the pivoting of the component about the pivot. In some embodiments, the blocking member 200 can be the sole safety mechanism; that is, the blocking member 200 is utilized without the catch portion 146 instead of in addition to the catch portion 146.

Figure 20:
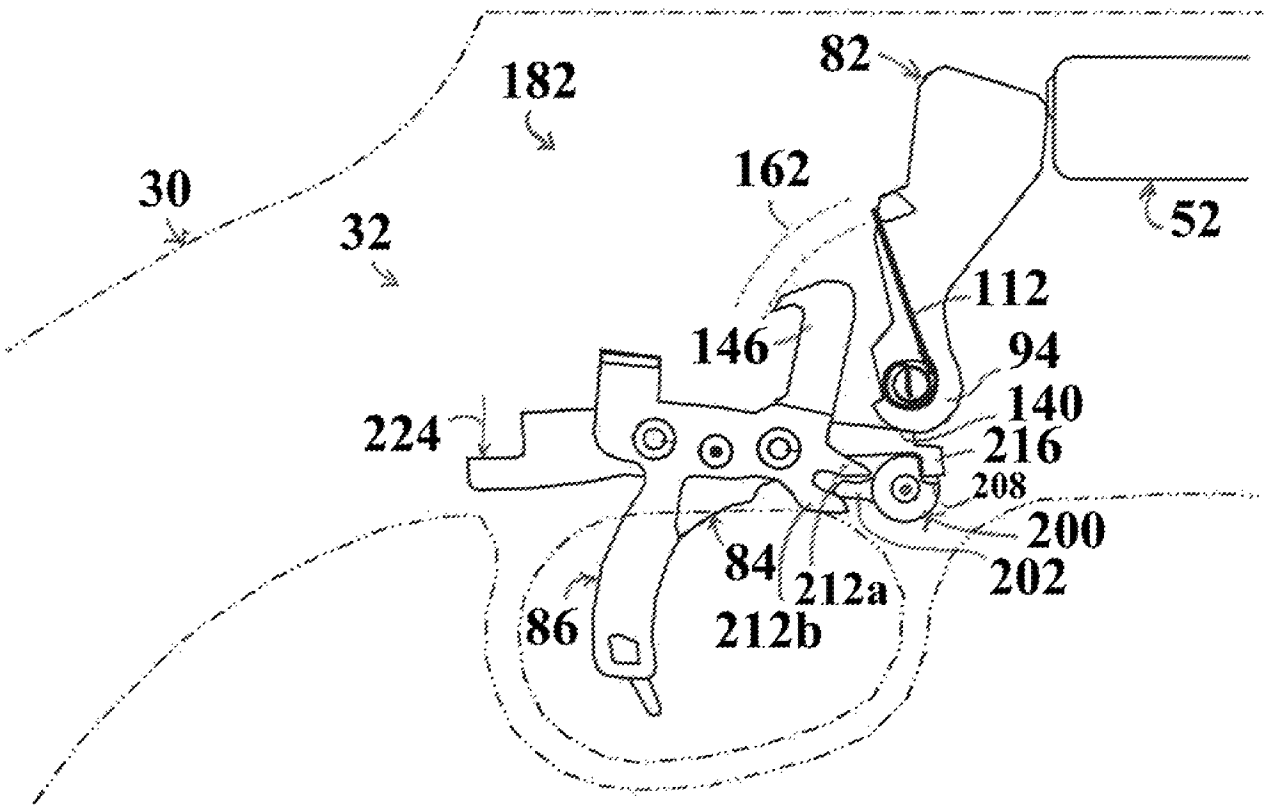
FIGS. 20-22 are side elevational schematic views of the trigger assembly components during a cocking sequence to restore the trigger assembly from the triggered configuration to the fully cocked configuration in an embodiment of the disclosure.
Figure 21:
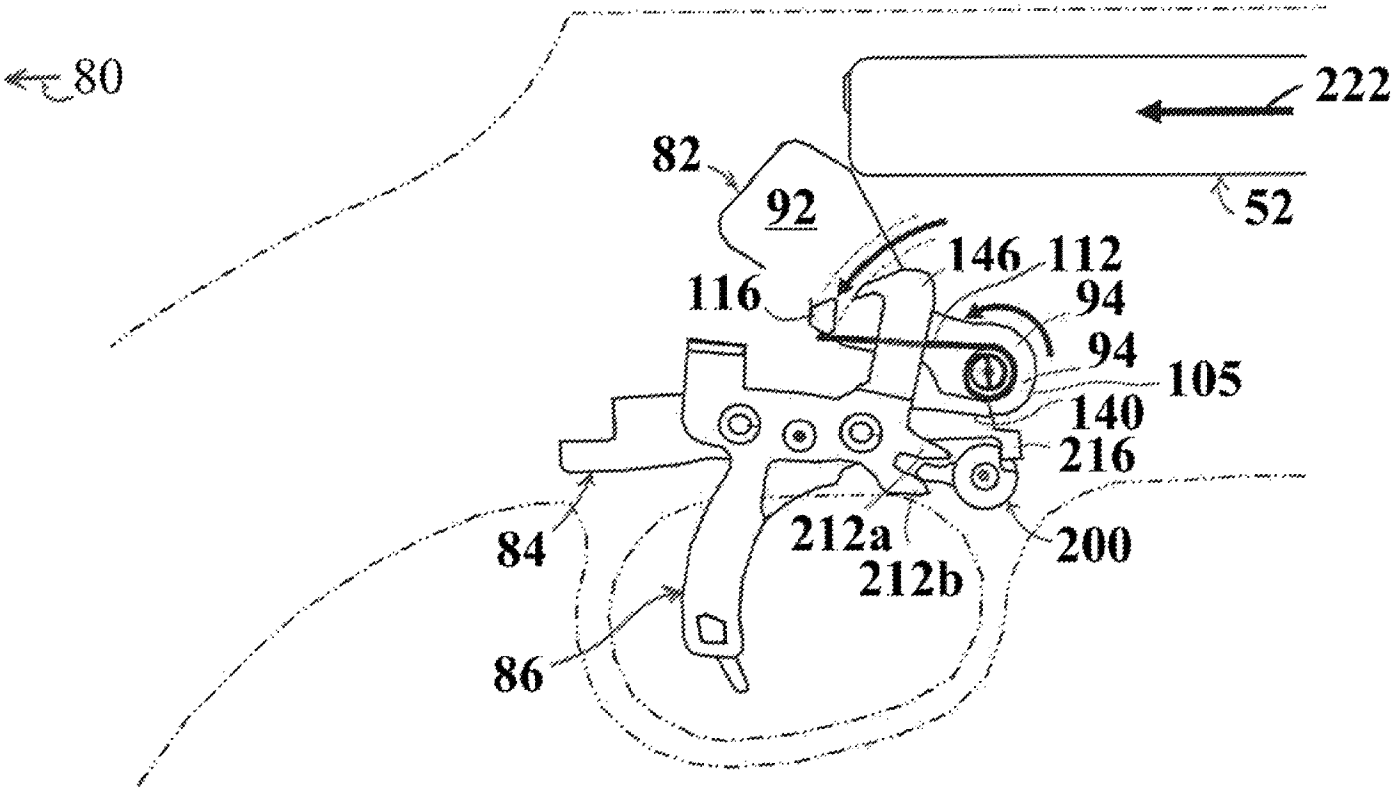
Figure 22:
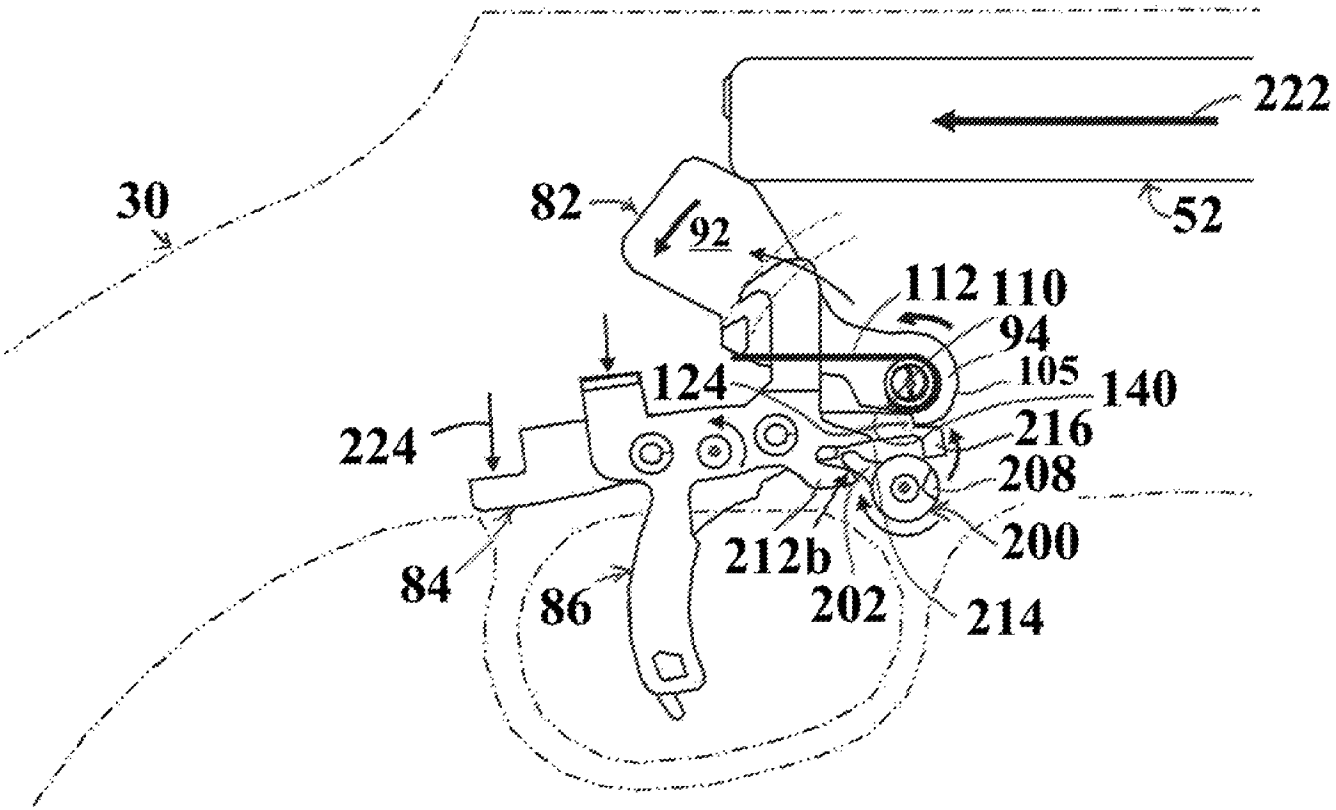

Referring to FIGS. 20 through 22, restoring the trigger assembly 32 from the triggered configuration 182 to the fully cocked configuration 180 (referred to herein as "cocking") is depicted in an embodiment of the disclosure. After discharge of the firearm 30, the projection 216 of the firing trigger component 84 is seated in the recess 208, held in place by the cam portion 94 of the hammer 82 (FIG. 20). The seating of the projection 216 in the recess 208 prevents rotation of the blocking member 200; that is, in the triggered configuration 182, the orientation of the blocking member 200 is not controlled by the safety trigger component 86 (as is the case in the fully cocked configuration 180), but instead is controlled by the firing trigger component 84 and hammer 82. Accordingly, the blocking member 200 now acts against protrusion 212*b* to hold the safety trigger component 86 in a pitched orientation, wherein the catch portion 146 is rotated away from the rotational path 162 of the capture feature 116.

The bolt assembly 52 is motivated in the forward direction 80 by a force 222, imparted, for example, manually by a gunman or by a blow back mechanism. This motivation causes the bolt assembly 52 to rotate the head portion 92 of the hammer 82 in the forward direction 80, which further causes the cam portion 94 to rotate on the cam engagement surface 140. The cam engagement surface 140 is maintained in contact with the cam portion 94 by a return force 224 imparted on the firing trigger component 84 by the firing trigger return spring 136.

As the head portion 92 of the hammer 82 is rotated in the forward direction 80, the capture feature 116 is rotated below the hook of the catch portion 146 (FIG. 13), while the cam portion 94 of the hammer 82 maintains the interlock between the firing trigger component 84 and safety bar 200 (and therefore the pitched orientation of the safety trigger component 86).

At some point after the capture feature 116 of the hammer 82 is rotated below the hook of the catch portion 146, the arcuate cam surface 105 of the cam portion 94 rotates off the cam engagement surface 140 (FIG. 14). At this point, the arcuate cam surface 105 of the cam portion 94 releases the firing trigger component 84. The firing trigger component 84, motivated by the return force 224 generated by the firing trigger return spring 136, then rotates (counterclockwise in FIG. 14) so that the cam engagement surface 140 is brought into contact with the flat 110 of the cam portion 94; the sear portion 124 of the firing trigger component 84 is brought adjacent to the sear engagement portion 106 of the hammer 82. The release of the firing trigger component 84 by the arcuate cam surface 105 also causes the projection 216 of the firing trigger component 84 to become unseated from recess 208 of the blocking member 200. Control of the orientation of the blocking member 200 is thereby transferred to the safety trigger component 86, which, propelled by the return force 224, rotates the blocking member 200 (clockwise in FIG. 22) into the underside 214 of the firing trigger component 84.

Upon withdrawal of the bolt assembly from contact with the hammer 82 and into the firing position, the fully cocked configuration 180 of the firearm 30 is restored (e.g., FIG. 17), with the blocking member 200 preventing actuation of the firing trigger component 84 that is independent of actuation of the safety trigger component 86, and the catch portion 146 poised to intercept the hammer 82 in case of unintentional release of the hammer 82.

In one embodiment, and again in reference to FIGS. 4 through 10 and 12, the blocking member 200 is part of a manual safety mechanism 230 that can be translated with the blocking member 200 laterally within the trigger mechanism housing 58 along a blocking member axis 234. When part of the manual safety mechanism 230, the lever 202 of the blocking member 200 can be selectively engaged with a stop 236 (best seen in FIGS. 5B and 6) that extends from the interior surface 44 of the trigger mechanism housing 58 along the right side wall 237 of the trigger mechanism housing 58. In the embodiment illustrated, when the manual safety mechanism 230 is pushed in one direction (e.g., to the right in the depicted embodiments), the firearm 30 is configured in a "safety mode," wherein the blocking member lever 202 is prevented from rotating out of the blocking position by the ramp or stop 236.

When the manual safety mechanism 230 is pushed in an opposite direction (e.g., to the left in the depicted embodiments), the firearm is configured in a "firing mode," wherein release of the sear portion 84 of the firing trigger component 84 from the sear engagement portion 106 of the hammer 82 is enabled. In the firing mode, the lever portion 202 is displaced off of the stop 236, enabling rotation by the fork 211 of the safety trigger component 86 and rotation the lever portion 202 out of the blocking position with the underside 214 of the firing trigger component 84. The lever 202 can be sized widthwise such that, during lateral movement of the blocking member 200, the lever maintains engagement of the safety trigger fork 211. Also, the lever 202, when engaged with the underside 214 on the lower side of the firing trigger component 84, can maintain blockage and/or engagement with the underside 214 during lateral actuation. Engagement with the underside 214 is lost only upon the rotation of the blocking member 200.

It is further noted that aspects of the embodiments depicted in FIGS. 17 through 22 may be suited for automatic operation. (Herein, "automatic operation" is characterized as the continuous, round after round discharge of ammunition as long as the firing trigger component 84 is depressed.) For the embodiments of FIGS. 17 through 22, as long as the triggers 84 and 86 are held in the firing position (depicted in FIG. 19), the sear portion 124 of the firing trigger component 84 will not be brought into engagement with the sear engagement portion 106 of the hammer 82, and the catch portion 146 will not obstruct the hammer 82 in either rotational direction.

Figure 23:
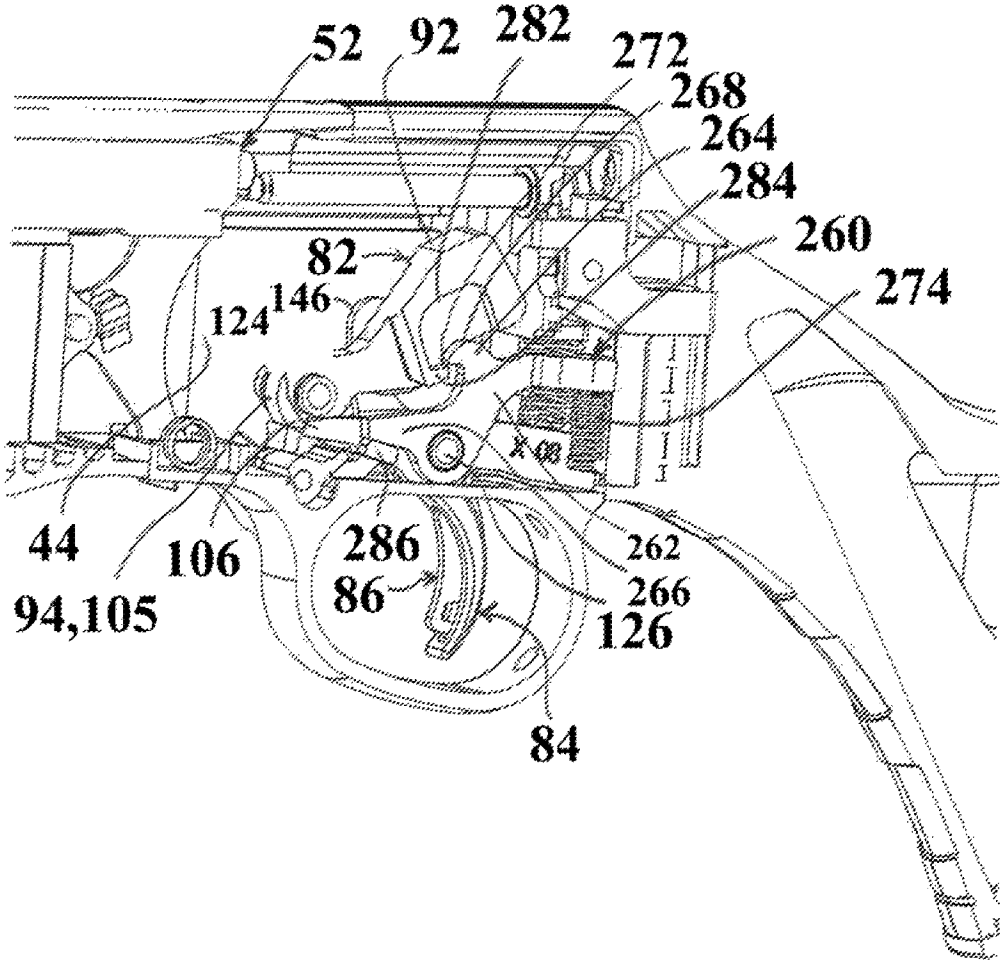
FIG. 23 is a reverse front perspective view of the trigger assembly components and illustrating the arresting mechanism that facilitates semi-automatic operation in an embodiment of the disclosure.
Figure 24:
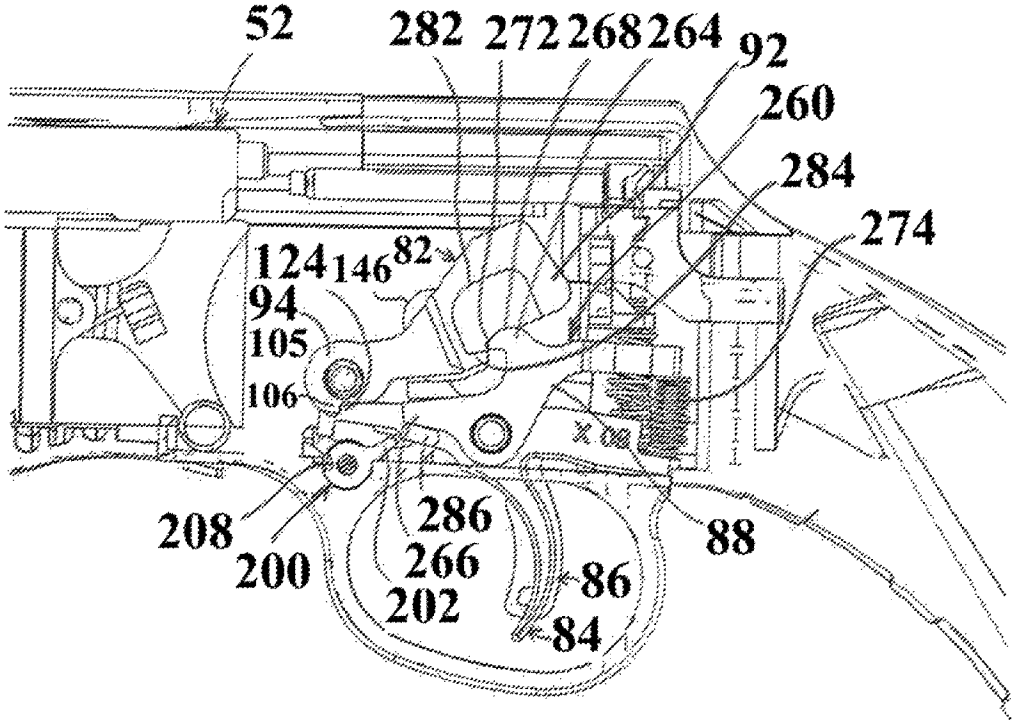
FIG. 24 is a side elevational view of the trigger assembly components and arresting mechanism of FIG. 23.
Figure 25:
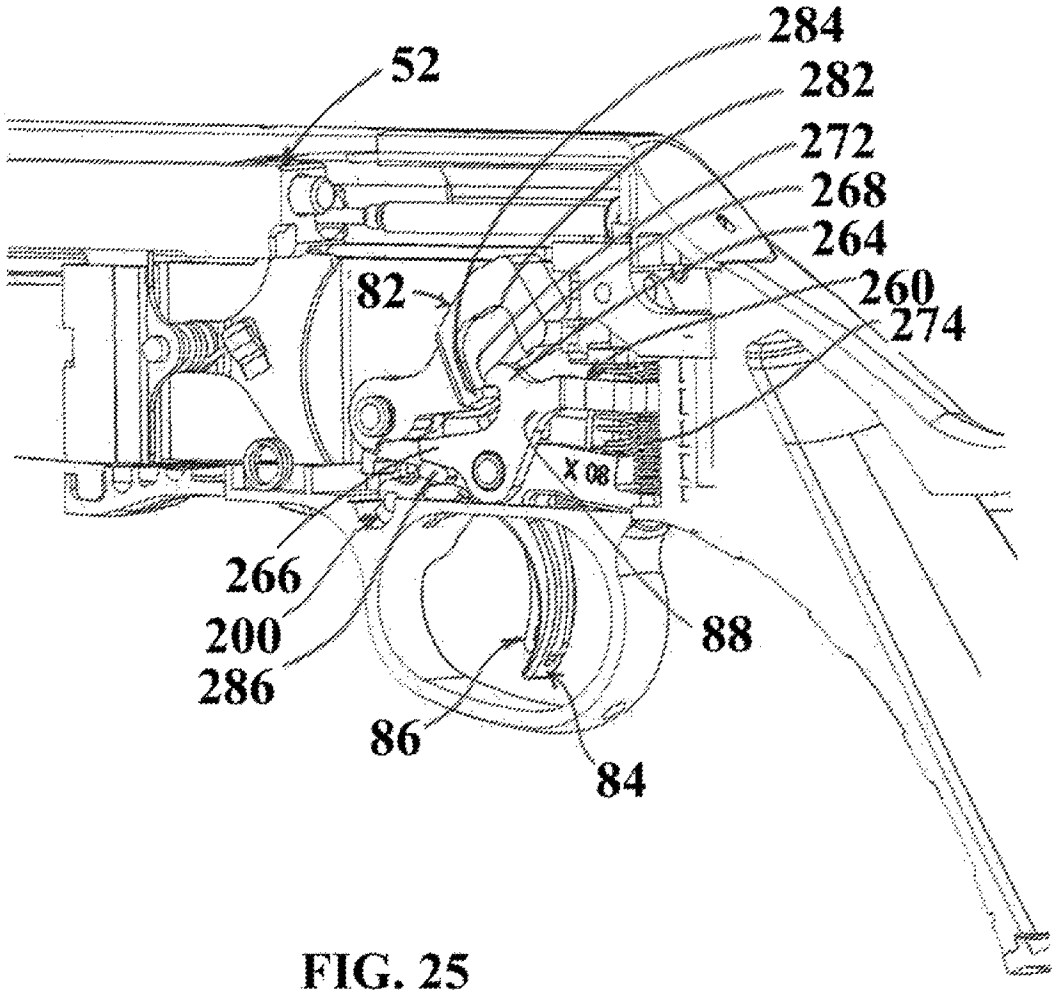
FIG. 25 is a side reverse rear perspective view of the trigger assembly components and arresting mechanism of FIG. 23.

Referring to FIGS. 23 through 25, an arresting mechanism 260 that facilitates semi-automatic operation (as opposed to automatic operation) is depicted in an embodiment of the disclosure. (Herein, "semi-automatic operation" is characterized by the automatic reloading of the firearm 30, but the requirement to release and re-actuate the triggers 84 and 86 to initiate firing.)

In one embodiment, the arresting mechanism 260 involves interaction of at least four components: the bolt assembly 52, the hammer 82, the firing trigger component 84, and an arrestor 88. The arrestor 88 is pivotally mounted within the housing 38 and distal to the hammer 82. In one embodiment, the arrestor 88 includes a claw portion 264 and a rocker arm portion 266. The claw portion 264 can include a rounded head portion 268 and a radiused nose 272. An arrestor return spring 274 can be operatively coupled to the arrestor 88. In one embodiment, the arrestor 88 is pivotally mounted to the trigger pivot 126.

In various embodiments, the arresting mechanism 260 can include a cavity 282 formed in the head portion 92 of the hammer 82, the cavity 282 and head portion 92 further defining a lip portion 284. In one embodiment, the firing trigger component 84 includes a lateral protrusion 286 that is part of the arresting mechanism, the lateral protrusion 286 being positioned to engage the rocker arm portion 266 of the arrestor 88.

In one embodiment, the arrestor 88 is configured and positioned so that the claw portion 264 is engageable with the lip portion 284 of the cavity 282 when the hammer 82 is hyperextended in the forward direction 80. Herein, the hammer 82 is considered "hyperextended" when the head portion 92 of the hammer 82 is displaced to be forward to where the head portion 92 is located when in the fully cocked configuration 180.

Referring to FIGS. 26 through 31, operation and function of the arresting mechanism 280 in a scenario where the triggers 84 and 86 become or remain actuated during the cocking of the firearm 30 is depicted in an embodiment of the disclosure. Functionally, the arresting mechanism 260 captures the hammer 82 and prevents the hammer 82 from automatically re-firing. To more closely resemble the views presented in FIGS. 23 through 25, the FIGS. 26 through 31 are presented in an opposing side view relative to the views of FIGS. 17 through 22. Also, for illustrative clarity, the biasing element 112, as well as the various return springs 136, 152 and 274, are not presented in FIGS. 26 through 31, though they may be present in certain embodiments. Also for illustrative clarity, only the components of the arresting mechanism 260 (i.e., the bolt assembly 52, the hammer 82, the firing trigger component 84, and an arrestor 88) are depicted in FIGS. 26 through 29.

Figure 26:
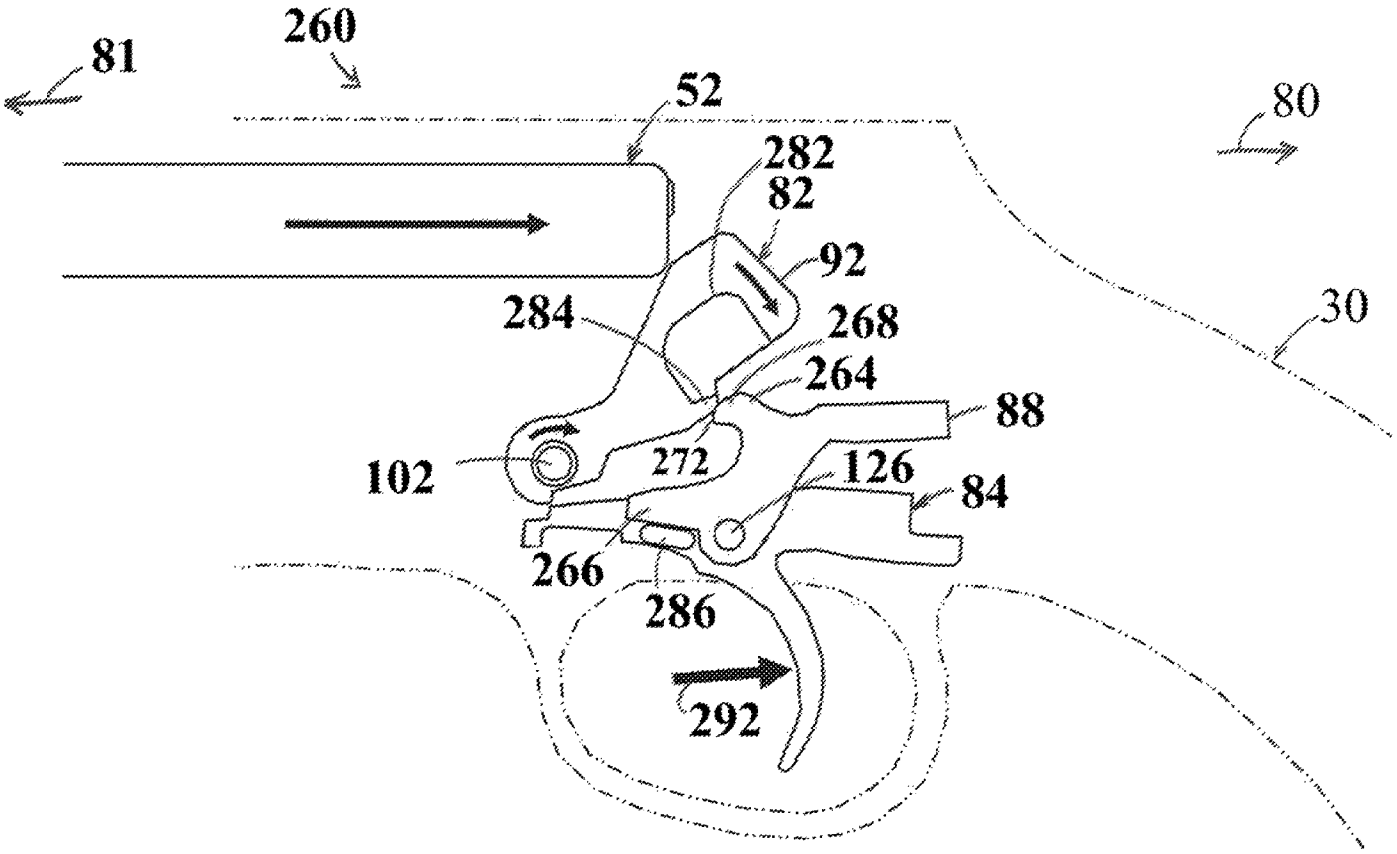
FIG. 26 is a schematic elevational view of operation of the arresting mechanism where the triggers become or remain actuated during the cocking of the firearm.
Figure 27:
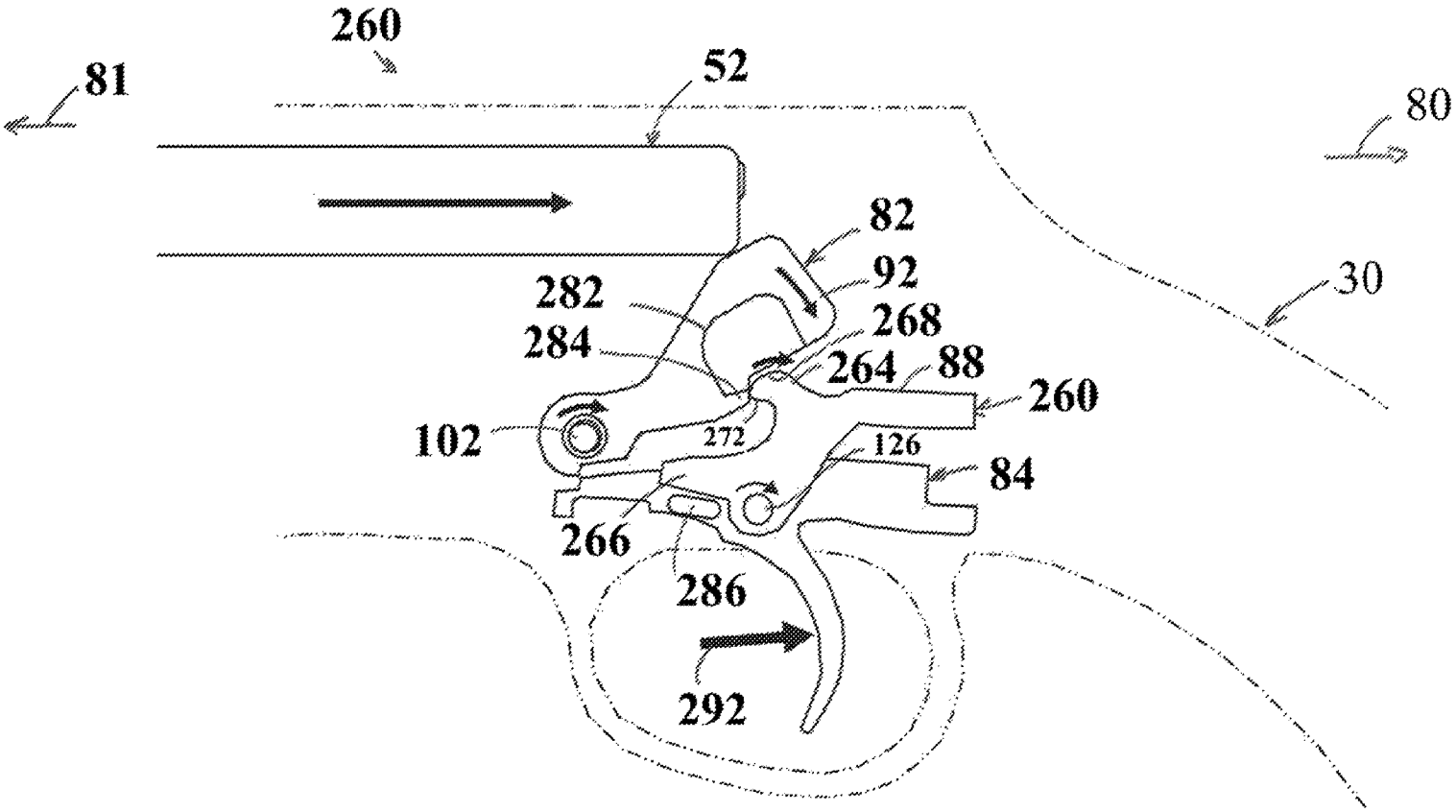
FIGS. 27-31 are side elevational schematic views of the trigger assembly components during the cocking sequence of FIGS. 20-22, illustrating operation of the arresting mechanism in an embodiment of the disclosure.
Figure 28:
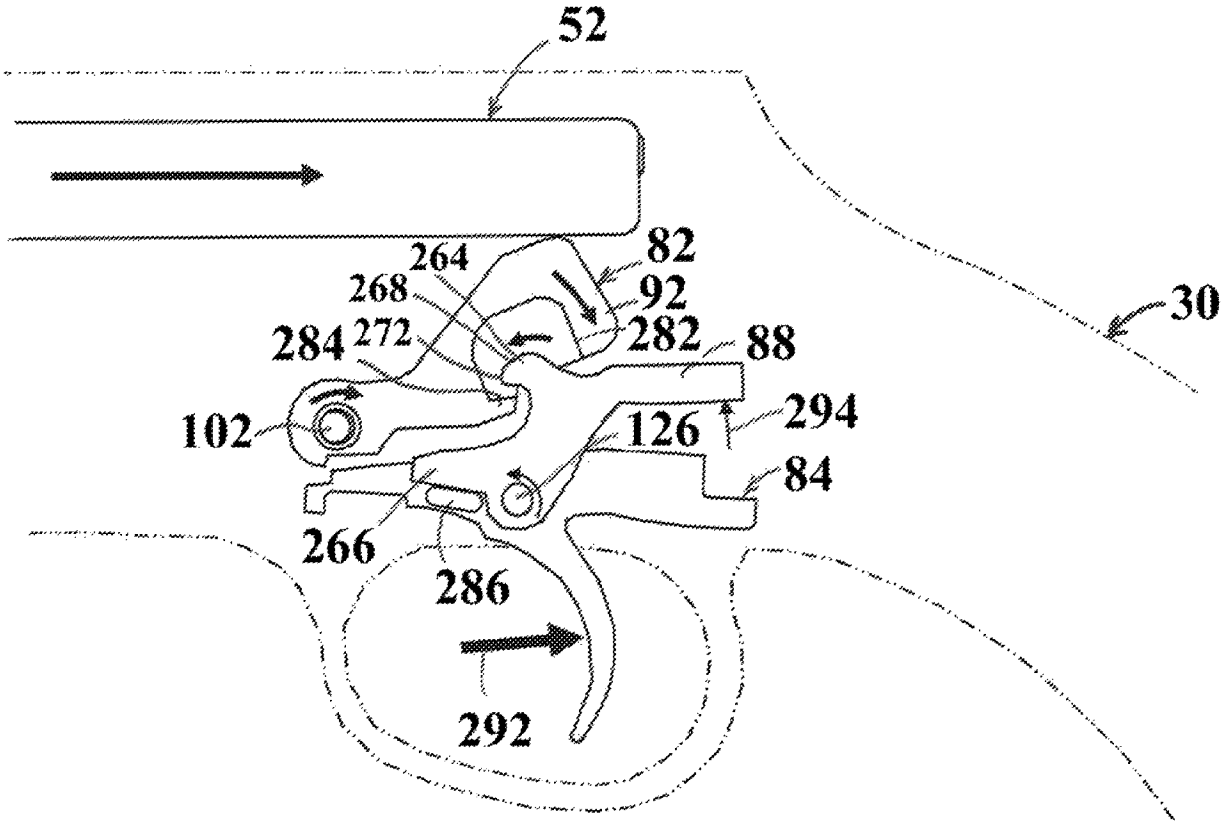

When an actuation force 292 is applied to the triggers 84 and 86, the lateral protrusion 286 of the firing trigger component 84 is pitched in the distal direction 81. The arrestor 88, being biased by the arrestor return spring 274, follows the firing trigger component 84, being stopped by the lateral protrusion 286. When the firing trigger component 84 is depressed, the lip portion 284 of the cavity 282 encounters the rounded head portion 268 and/or radiused nose 272 of the claw portion 264 as the head portion 92 of the hammer 82 is rotated in the forward direction 80 during cocking of the firearm 30 (FIG. 26). The interaction between the lip portion 284 and the rounded head portion 268, radiused nose 272 of the claw portion 264 to rotate slightly in the forward direction 80, such that the rocker arm portion 266 rotates off the lateral protrusion 286 of the firing trigger component 84 (FIG. 27). As the head portion 92 of the hammer 82 becomes hyperextended, the lip portion 284 slips past the radiused nose 272 of the claw portion 264, the arrestor 88 is rotated so that the rocker arm 266 is again in engagement with the lateral protrusion 286 of the firing trigger component 84, motivated by a return force 294 (FIG. 28) generated by the arrestor return spring 274. The rotation causes the claw portion 264 to rotate at least partially into the cavity 282.

Figure 29:
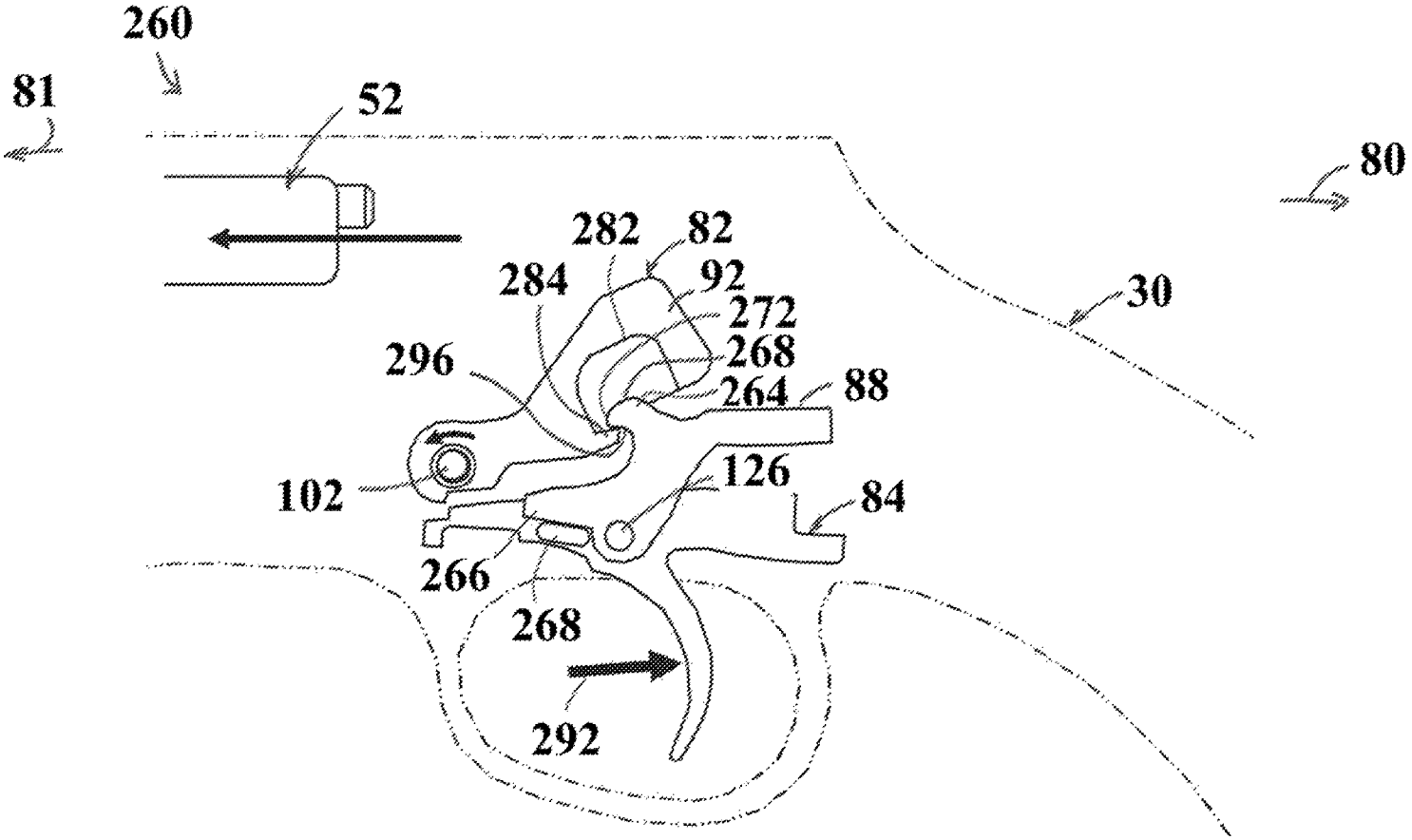

The bolt assembly 52 then retracts back into the firing position, becoming disengaged from the hammer 82 (FIG. 29). The disengagement causes the head portion 92 of the hammer 82 to rotate in the distal direction 81 until the lip portion 284 of the cavity 282 is hooked by an underside 296 of the claw portion 264. The arresting mechanism 260 remains in equipoise as long as the firing trigger component 84 remains in the actuated position. In this way, the arresting mechanism 260 captures the hammer 82 and prevents the hammer 82 from automatically re-firing.

Figure 30:
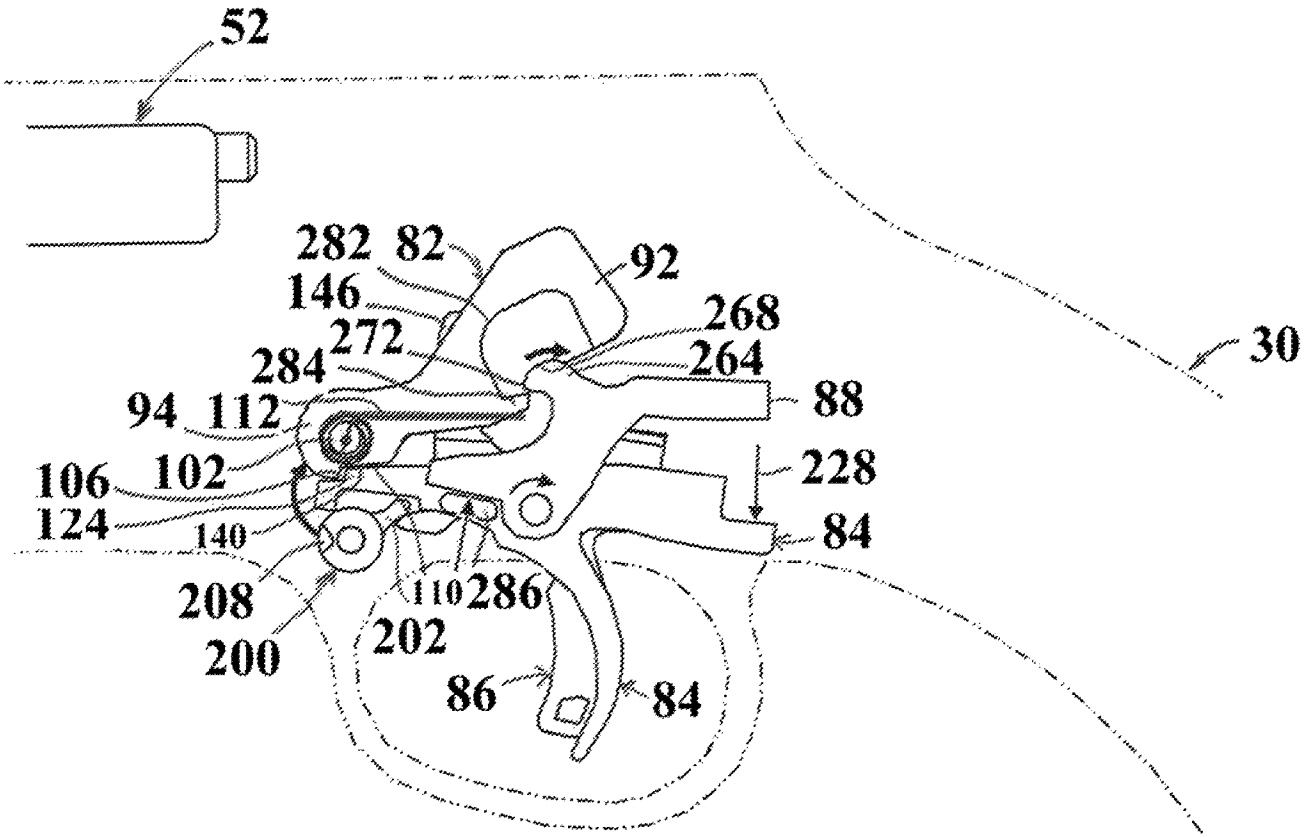

In one embodiment, upon removal of the actuation force 292 (e.g., when the gunman removes his finger from the firing trigger component 84), the return force 228 of the firing trigger return spring 136 causes rotation of the firing trigger component 84 so that the lateral protrusion 286 of the firing trigger component 84 is rotated upwards (clockwise in FIG. 30). The lateral protrusion 286 causes the rocker arm 266 of the arrestor 88 to also rotate upward, thereby decoupling the lip portion 284 of the cavity 282 from the underside 296 of the claw portion 264. The lip portion 284 of the hammer 82 then slips past the radiused nose 272 of the claw portion 264, being motivated by the biasing element 112, thereby releasing the hammer 82 from the arrestor 88.

Figure 31:
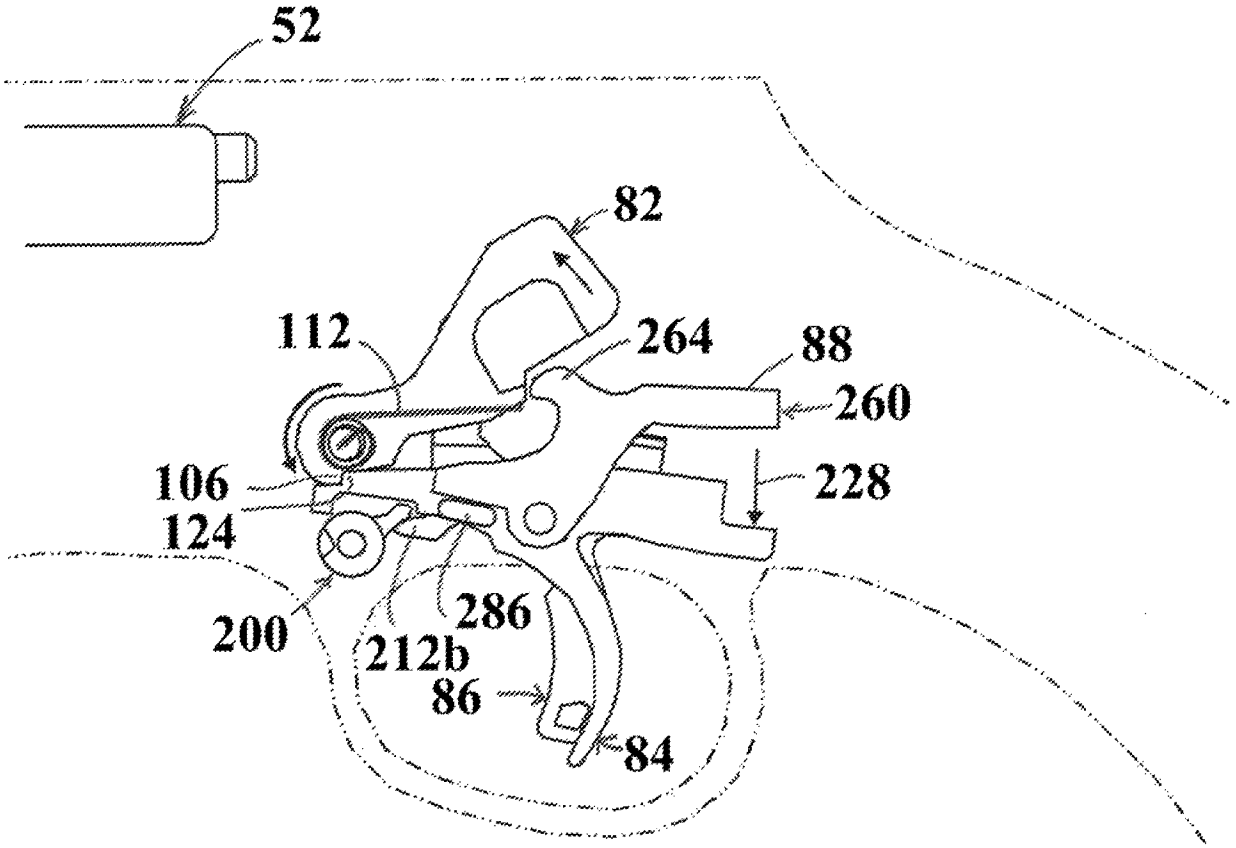

The rotation of the firing trigger component 84 upon removal of the actuation force 292 also causes the cam engagement surface 140 to come into contact with the flat 110 of the cam portion 94, which brings the sear portion 124 of the firing trigger component 84 proximate and adjacent to, but not in contact with, the sear engagement portion 106 of the hammer 82 (FIG. 30). Upon release of the hammer 82 from the arrestor 88, the head portion 92 of the hammer 82 further rotates in the distal direction 81, until the bearing face 108 of the sear engagement portion 106 is fully registered against the sear portion 124 of the firing trigger component 124 (FIG. 31). The trigger assembly 32 is then in the fully cocked configuration 180.

It is further noted that, in various embodiments, if the firing trigger component 84 is not actuated when the hammer 82 reaches the hyperextended position, the arrestor 88 is not in a position to engage and/or secure the lip portion 284 of the hammer 82. Accordingly, the arrestor 88 does not substantially interfere with the cocking operation if the firing trigger component 84 is not actuated.

The barrel and receiver may be conventionally manufactured from steel. In various embodiments, other metals may be used. The components of the trigger assembly cluster are generally conventionally formed from steel or other metals. In some instances, polymers may replace some components. For example the trigger mechanism housing may be made from polymers and composite materials. Metal inserts may be used for particular areas requiring high strength such as attachment locations. See projection 60 and the trigger guard 56 (see FIGS. 5A and 5B). Also, see FIG. 3 the polymer access cover 290 has a metal insert 291 for strength and providing the catch surfaces. The polymer may be overmolded over the insert capturing the insert. The stock can be formed from polymers or wood or composite materials.

Figure 32:
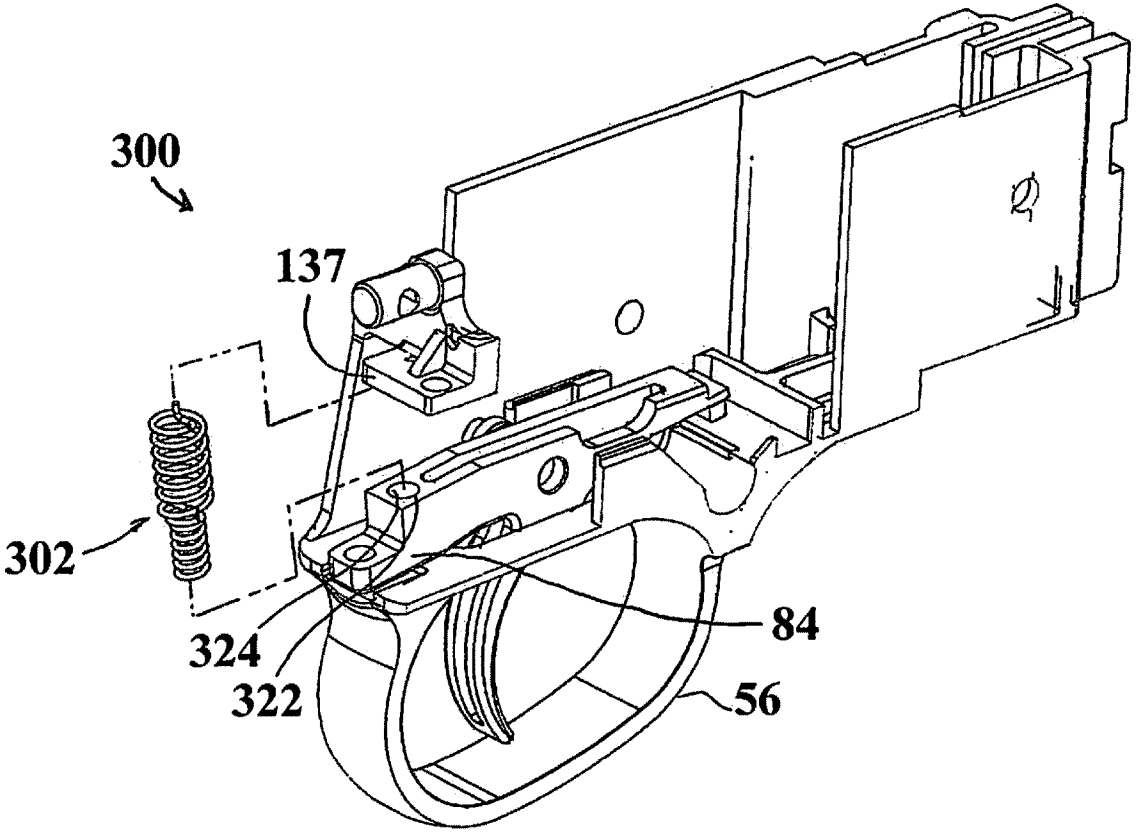
FIG. 32 is a partially exploded cutaway view of a trigger pull adjustment mechanism in an embodiment of the disclosure.
Figure 33:
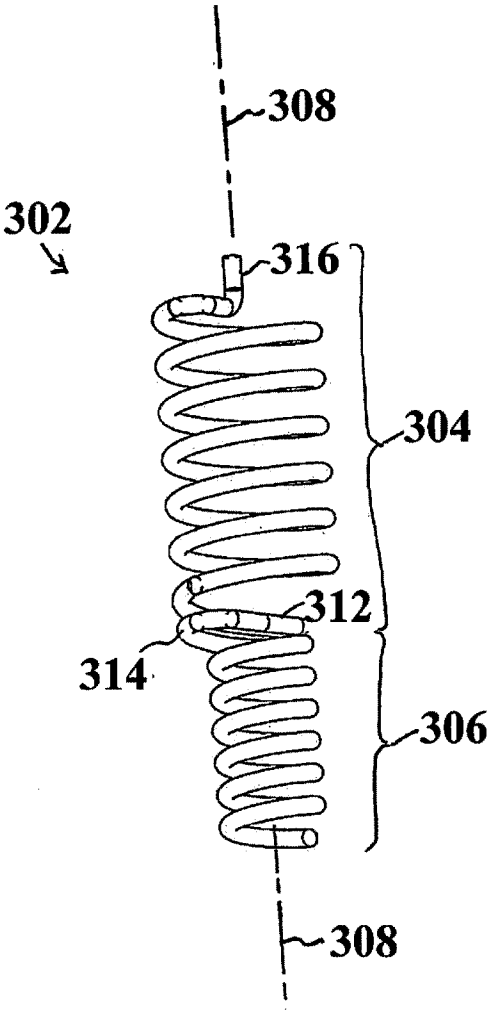
FIG. 33 is an enlarged perspective view of a firing trigger return spring for the trigger pull adjustment mechanism of FIG. 32 in an embodiment of the disclosure.

Referring to FIGS. 32 and 33, a trigger pull adjustment mechanism 300 is depicted in an embodiment of the disclosure. The trigger pull adjustment mechanism 300 comprises an adjustable firing trigger return spring 302 disposed in place of the firing trigger return spring 136 (as depicted, for example, in FIG. 10) and operatively coupled to the ledge portion 137 and the firing trigger component 84 to exert a separating force therebetween. This separating force constitutes a component of the pull or actuation force required to actuate the firing trigger component 84 for releasing the hammer 82.

In the depicted embodiment, the adjustable firing trigger return spring 302 includes an upper portion 304 and a lower portion 306 spiral wound about a spring axis 308. A transition segment 312 can be formed in the lower-most spiral 314 of the upper portion 304, the transition segment 312 passing through the adjustable firing trigger return spring 302 proximate the spring axis 308. In one embodiment, the transition segment 312 is substantially linear over a portion thereof. In the way, the transition segment 312 obstructs what would otherwise be a clear passage through the adjustable firing trigger return spring 302. The upper and lower portions 304 and 306 can be of different diameter, as depicted. Also in the depicted embodiment, the upper portion 304 terminates with a tail portion 316 that is substantially concentric with the spring axis 308. The ledge portion 137 can define a mounting hole 318 within which the tail portion 316 is mounted in assembly.

In assembly, the lower portion 306 of the adjustable firing trigger return spring 302 is firmly seated within a through-hole 322 defined on the firing trigger component 84. The firm seating of the lower portion 306 within the through-hole 322 can be accomplished by an interference fit between an inner wall 324 of the through-hole 322 and the lower portion 306 of the spring 302 as wound. The interference fit provides a high degree of friction between the inner wall 324 of the through-hole 322 and the lower portion 306 of the spring 302, thereby fixing the compressed length of the spring 302. In this embodiment, while the friction is sufficient to maintain the compressed length 302 of the spring when the firearm 30 is in the fully cocked configuration 180 (i.e., prior to actuation of the firing trigger component 84), the spring 302 In one embodiment, the through-hole 322 is tapered to augment the seating operation during assembly and rotation of the spring 302 during an adjustment.

Figure 34:
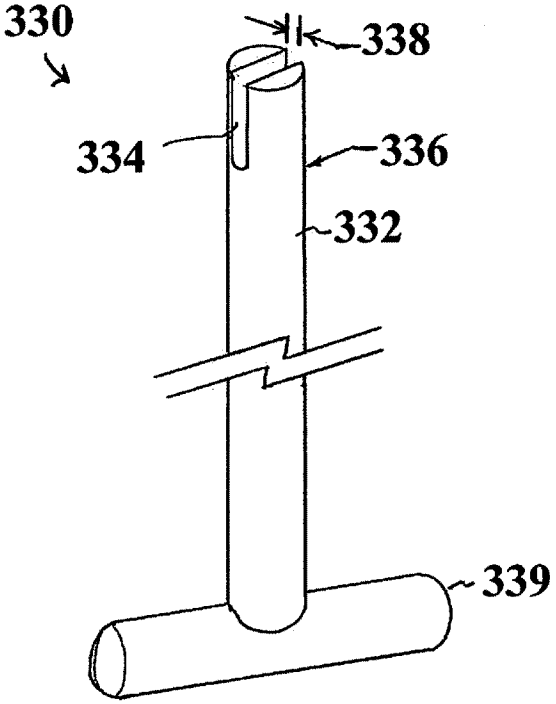
FIG. 34 is a perspective view of an adjustment tool for use with the trigger pull adjustment mechanism of FIG. 32 in an embodiment of the disclosure.

Referring to FIG. 34, an adjustment tool 330 for rotating the adjustable firing trigger return spring 302 is depicted in an embodiment of the disclosure. The adjustment tool 330 includes a shaft portion 332 with a slot 334 defined on one end thereof. A diameter 336 of the shaft portion 332 is dimensioned to readily pass through the interior of the lower portion 306 of the spring 302. A width 338 of the slot 334 is dimensioned to receive the transition segment 312 of the spring 302. Optionally, the adjustment tool 330 includes a handle portion 339 disposed proximate the end of the adjustment tool 330 that is opposite the slot 334.

Figure 35:
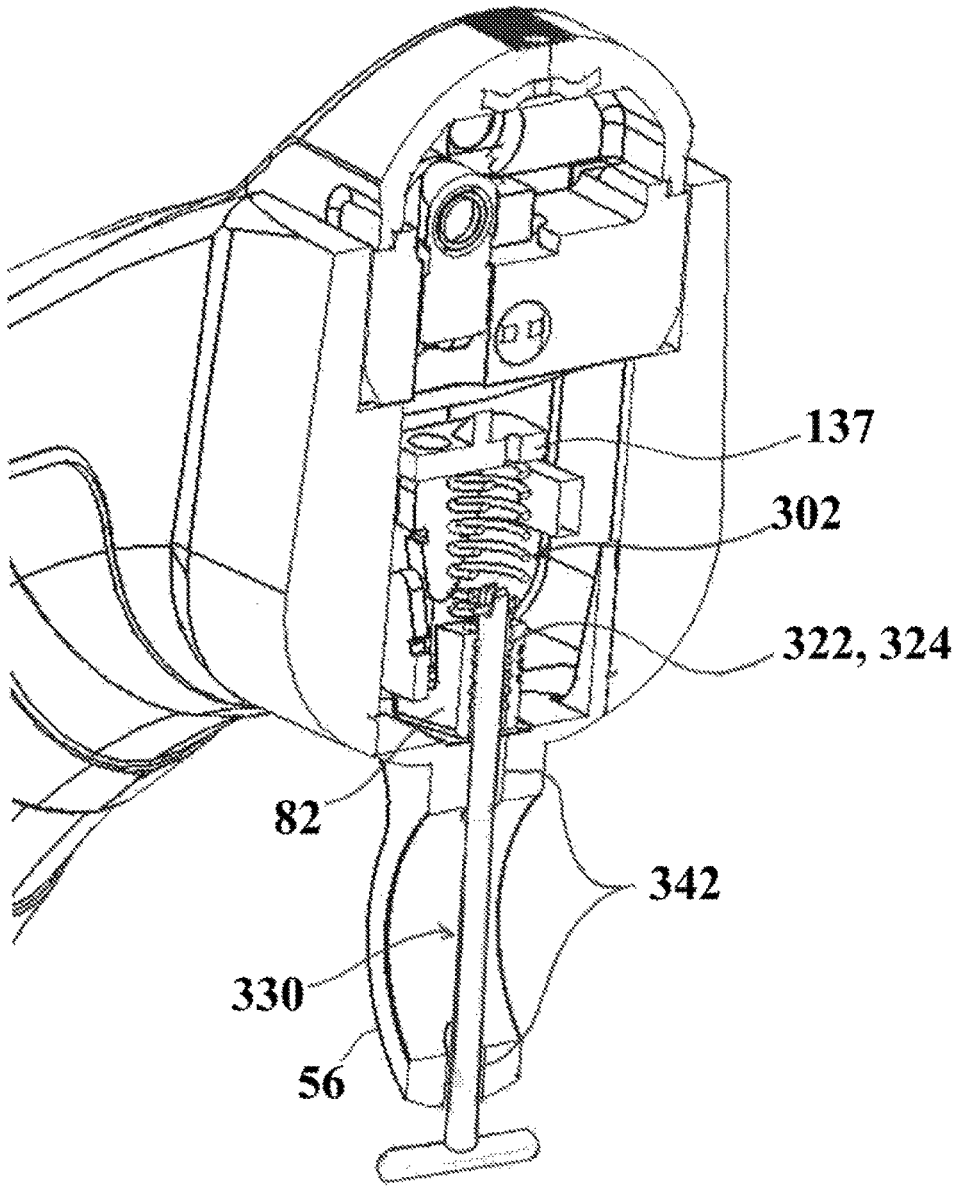
FIG. 35 is a sectional view of the trigger pull adjustment mechanism of FIG. 32 in assembly and operation of the adjustment tool of FIG. 34 in an embodiment of the disclosure.

Referring to FIG. 35, adjustment of the trigger pull adjustment mechanism 300 is depicted in an embodiment of the disclosure. In the depicted embodiment, access passages 342 are formed in the trigger guard 56, sized to allow passage of the shaft 332 of the adjustment tool 330. The adjustment tool 330 is inserted through the access passages 342 and the lower portion 306 of the adjustable firing trigger return spring 302 and brought into contact with the transition segment 312. The adjustment tool is rotated and pushed against the transition segment so that the slot 334 is aligned with and accepts the transition segment 312. With the transition segment 312 seated within the slot 334, the adjustment tool 330 is rotated to overcome the friction between the lower portion 306 and the inner wall 324 of the through-hole 322, thereby changing the compressive force of the spring 302 when in the battery position. By increasing the compression of the spring 302, the restorative force generated by the spring 302 is increased, thereby increasing the pull required to actuate the firing trigger component 84; by decreasing the compression of the spring 302, the restorative force generated by the spring 302 is decreased, thereby decreasing the pull required to actuate the firing trigger component 84. The friction between the lower portion 306 and the inner wall 324 of the through-hole 322 is sufficient to maintain the adjusted compression of the spring 302 during operation of the firearm 30.

Accordingly, the disclosed trigger pull adjustment mechanism 300 accomplishes adjustment of the trigger pull with fewer components and with reduced machining complexity. For example, conventional trigger pull adjustments utilize an additional set screw that requires a threaded hole for the compression adjustment. The trigger pull adjustment mechanism 300 eliminates the need for these components and attendant complexity.

Other adjustable trigger mechanisms can be implemented instead. Such mechanisms are illustrated, for example, in U.S. Pat. No. 6,553,706, owned by the owner of this application, the disclosure of which is hereby incorporated reference herein in its entirety except for express definitions and patent claims contained therein. See also U.S. Pat. Nos. 8,220,193 and 8,250,799, the disclosures of which are hereby incorporated reference herein in their entirety except for express definitions and patent claims contained therein.

The above references in all sections of this application are herein incorporated by references in their entirety for all purposes. For purposes of interpreting the claims, it is expressly intended that the provisions of Section 112, sixth paragraph of 35 U.S.C. are not to be invoked unless the specific terms "means for" or "step for" are recited in a claim.

All of the disclosures in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

When "linked", "coupled", and "connected" are used herein, the terms do not require direct component to component physical contact connection, one or more intermediary components may be present.

Inventions flowing from the present disclosure are not restricted to the details of the foregoing embodiment(s). The inventions extend to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described embodiments are merely descriptive of its principles and are not to be considered limiting. Further modifications of the embodiments herein disclosed will occur to those skilled in the respective arts and all such modifications are deemed to be within the scope of the inventions.

What is claimed is:

1. A firearm including a trigger assembly having passive and redundant safety mechanisms to prevent unintentional firing when the firearm is in a firing mode, the trigger assembly comprising:

a hammer rotatable about a first axis, said hammer including structure defining a capture feature;

a firing trigger component rotatable about a second axis and including a first finger hook portion, said firing trigger component including a sear portion releasably coupled to said hammer; and a safety trigger component rotatable about said second axis and including a second finger hook portion, said second finger hook portion extending adjacent to and forwardly of said first finger hook portion when said trigger assembly is in a battery position, wherein a first of said redundant safety mechanisms includes a catch portion defined on said safety trigger component and, when said safety trigger component is in a battery position, is positioned for arresting said capture feature of said hammer as said hammer rotates, to prevent discharge of said firearm, wherein a second of said redundant safety mechanisms includes a blocking member operatively coupled with said safety trigger component for maintaining said blocking member in a blocking position when said safety trigger component is in a battery position, said blocking member blocking said firing trigger component when in said blocking position to prevent release of said sear portion from said hammer, said blocking member being operatively coupled with said safety trigger component for moving said blocking member out of said blocking position by moving said safety trigger component out of said battery position to enable release of said sear portion from said hammer.

2. The firearm of claim 1, wherein said blocking member includes an arcuate base portion rotatable about a third axis, said arcuate base portion defining a recess and being operatively coupled with said safety trigger component for rotation about said third axis, wherein:

the arcuate base portion blocks said firing trigger component from being actuated when said safety trigger component is in said battery position; and the recess aligns with said firing trigger component when said safety trigger component is rotated out of said battery position to enable said firing trigger component to release said hammer.

3. The firearm of claim 1, wherein said blocking member includes a lever portion operatively coupled with said safety trigger component for rotation about a third axis, wherein said lever portion blocks an underside of said firing trigger component to prevent disengagement of said firing trigger component from said hammer, said lever portion being maintained in said blocking position by said safety trigger component when said safety trigger component is in said battery position, said lever portion being selectively rotatable out of said blocking position by rotating said safety trigger component out of said battery position.

4. The firearm of claim 1, wherein said trigger assembly further comprises a manual safety mechanism actuated by a push button forward of said first finger hook portion and laterally actuated for selectively placing said firearm in one of a safety mode and a firing mode, said manual safety mechanism being operatively coupled to said blocking member for preventing said safety trigger component from moving said blocking member out of said blocking position when in said safety mode, and enabling said safety trigger component to move said blocking member out of said blocking position when in said firing mode.

5. The firearm of claim 4, wherein said blocking member includes an arcuate base portion rotatable about a third axis, said arcuate base portion defining a recess and being operatively coupled with said safety trigger component for rotation about said third axis, wherein:

the arcuate base portion blocks said firing trigger component from being actuated when said safety trigger component is in said battery position and when said firearm is in said safety mode and in said firing mode; and the recess aligns with said firing trigger component when said firearm is in said firing mode and said safety trigger component is rotated out of said battery position to enable said firing trigger component to release said hammer.

6. The firearm of claim 5, wherein said blocking member includes a lever portion that extends from said arcuate base portion and is operatively coupled with said safety trigger component for rotation about a third axis, wherein said lever portion blocks said firing trigger component to prevent disengagement of said firing trigger component from said hammer, said lever portion being maintained in said blocking position by said safety trigger component when said safety trigger component is in said battery position and said firearm is in said firing mode, said lever portion being selectively rotatable out of said blocking position when said firearm is in said firing mode by rotating said safety trigger component out of said battery position.

7. The firearm of claim 4, wherein said blocking member includes a lever portion operatively coupled with said safety trigger component for rotation about a third axis, wherein said lever portion blocks said firing trigger component to prevent disengagement of said firing trigger component from said hammer, said lever portion being maintained in said blocking position by said safety trigger component when said safety trigger component is in said battery position and said firearm is in said firing mode, said lever portion being selectively rotatable out of said blocking position when said firearm is in said firing mode by rotating said safety trigger component out of said battery position.

8. The firearm of claim 4, wherein said lever portion contacts said firing trigger component when said safety trigger component is in said battery position.

9. The firearm of claim 1, wherein said firearm includes a bolt assembly translatable forwardly and rearwardly and parallel to a barrel axis of a barrel, said bolt assembly including a firing pin that is offset from said barrel axis for firing rimfire cartridges, said barrel including a chamber configured for necked cartridges.

10. The firearm of claim 1, wherein rearward deflection of said safety trigger component causes rotation of said blocking member.

11. The firearm of claim 1, further comprising means for arresting said hammer to facilitate semi-automatic operation.

12. The firearm of claim 1, further comprising means for adjusting a pull required to actuate said firing trigger component.

13. The firearm of claim 1, wherein said first finger hook portion defines a slot, said second finger hook portion being disposed in said slot.

* * * * *